US006783853B2

(12) United States Patent
Figuly et al.

(10) Patent No.: US 6,783,853 B2
(45) **Date of Patent: *Aug. 31, 2004**

(54) HETERO-COMPOSITE YARN, FABRICS THEREOF AND METHODS OF MAKING

(75) Inventors: Garret D. Figuly, Wilmington, DE (US); Marc B. Goldfinger, West Chester, PA (US); Rakesh H. Mehta, Hockessin, DE (US); H. Vaughn Samuelson, Chadds Ford, PA (US); Anthony J. Soroka, Hixson, TN (US); Gregory P. Weeks, Hockessin, DE (US)

(73) Assignee: Invista North America S.a.r.l., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/256,346

(22) Filed: Sep. 27, 2002

(65) Prior Publication Data

US 2003/0186051 A1 Oct. 2, 2003

Related U.S. Application Data

(60) Provisional application No. 60/325,619, filed on Sep. 28, 2001.

(51) Int. Cl.[7] ..... D01F 8/00

(52) U.S. Cl. ..... 428/370; 428/373; 428/374; 428/397

(58) Field of Search ..... 428/370, 373, 428/374, 397

(56) References Cited

U.S. PATENT DOCUMENTS

| | | | | |
|---|---|---|---|---|
| 2,936,482 | A | 5/1960 | Kilian | |
| 3,017,686 | A | 1/1962 | Breen et al. | |
| 3,418,200 | A | 12/1968 | Tanner | |
| 3,458,390 | A | 7/1969 | Ando et al. | |
| 3,468,975 | A | 9/1969 | Duxbury et al. | |
| 3,787,162 | A | 1/1974 | Cheetham | |
| 4,385,886 | A | 5/1983 | Samuelson | |
| 4,810,770 | A | 3/1989 | Greene et al. | |
| 4,861,660 | A | 8/1989 | Ishii | |
| 4,985,536 | A | 1/1991 | Figuly | |
| 5,162,074 | A | 11/1992 | Hills | |
| 5,171,633 | A | 12/1992 | Muramoto et al. | |
| 5,260,013 | A | 11/1993 | Samuelson | |
| 5,344,297 | A | 9/1994 | Hills | |
| 5,603,888 | A | 2/1997 | Blizzard et al. | |
| 5,677,057 | A | 10/1997 | Tashiro et al. | |
| 5,686,121 | A | 11/1997 | Samuelson | |
| 5,972,502 | A | 10/1999 | Jessee et al. | |
| 6,548,166 | B2 * | 4/2003 | Figuly et al. | 428/370 |

FOREIGN PATENT DOCUMENTS

| | | |
|---|---|---|
| DE | 19045 | 6/1960 |
| EP | 0233702 B1 | 8/1987 |

(List continued on next page.)

OTHER PUBLICATIONS

Additional Observations On Stratified Biocomponent Flow of Polymer Melts in A Tube, Journal of Polymer Science: Polymer Physics Edition, 1975, pp. 863–869, vol. 13, John Wiley & Sons, Inc.

(List continued on next page.)

*Primary Examiner*—N. Edwards

(57) ABSTRACT

A hetero-composite yarn useful in making garments comprises a combined biconstituent yarn and a companion yarn, wherein the biconstituent yarn comprises an axial core comprising a thermoplastic elastomeric polymer, and a plurality of wings attached to the core and comprising a thermoplastic, non-elastomeric polymer.

13 Claims, 13 Drawing Sheets

FOREIGN PATENT DOCUMENTS

| | | | |
|---|---|---|---|
| JP | 5921776 | A | 2/1984 |
| JP | 61289124 | A | 12/1986 |
| JP | 06025919 | A | 2/1994 |
| JP | 95-2819 | | 3/1995 |
| JP | 6-150524 | | 12/1995 |
| JP | 97078432 | | 3/1997 |
| WO | WO 9745575 | A1 | 12/1997 |
| WO | WO 0116232 | A1 | 3/2001 |
| WO | WO 01/64978 | A2 | 9/2001 |
| WO | WO 02/27082 | A1 | 4/2002 |
| WO | WO 02/27083 | A1 | 4/2002 |

OTHER PUBLICATIONS

Fitzgerald, W.E. and Knudsen, J. P., Mixed–Stream Spinning of Biocomponent Fibers, Textile Research Journal, 1967, pp. 447–453.

Hagewood, John, Ultra Microfibers: Beyond Evolution, IFJ, 1998, pp. 47–48.

* cited by examiner

HETERO-COMPOSITE YARN, FABRICS THEREOF AND METHODS OF MAKING

CROSS REFERENCE(S) TO RELATED APPLICATION(S)

This application claims priority of U.S. Provisional Patent Application 60/325,619 filed Sep. 28, 2001.

FIELD OF THE INVENTION

The invention relates to hetero-composite, preferably self-bulking, textile yarn with high stretch recovery, produced from a high-shrinkage, latent stretch, melt spun biconstituent fiber and one or more lower shrinkage fibers.

BACKGROUND OF THE INVENTION

Yarns which exhibit good bulk and stretch and recovery are made by a variety of processes, including false twist texturing of non-elastic or hard yarns, bicomponent yarns, wrap covering a hard yarn onto an elastomeric yarn, air covering or entangling a hard yarn with an elastomeric yarn, and core spinning of staple yarn covers on an elastomeric yarn. See, for example, U.S. Pat. No. 4,861,660 to Ishii. Fabrics of enhanced bulk, stretch and recovery properties are made by incorporating one or more of these yarn types into the fabric and/or by using an elastomeric, such as spandex, yarn, which is fed separately into the fabric production process.

Fabrics with good stretch and recovery properties generally require separate processes to prepare the hard yarns or at least a separate yarn feed for incorporating a stretchable, elastomeric yarn. Often the stretchable yarns will require special tensioning devices. For example, the elastomer often requires a covering step which can be expensive, slow, and requires careful control of elastic tension or draft. Once covered, e.g., by wrapping or air entangling, the yarn is still elastomeric in nature. Variability in tensioning of the elastomer component can lead to quality defects. Also, if the elastomer is not pre-covered other problems may occur, such as dye uniformity problems because elastomers dye differently than companion yarns, and/or early failure of bare elastomer which has lower tenacity than the companion yarns.

Ishii describes asymmetric biconstituent filament yarns that can be knitted and woven with nylon yarns in Examples 15 and 16 respectively. These examples teach knitting and weaving the biconstituent filament yarn and the nylon yarn separately in a fabric. In light of the extremely high shrinkage of biconstituent filament yarns, which are high stretch yarns, Ishii recognizes that relaxation of the biconstituent filament yarns is necessary to handle the yarn prior to making the fabric.

High stretch yarns require careful control of yarn tension to achieve uniform properties, and these properties can fluctuate due to denier variations, finish level, etc. Therefore, Ishii prefers tensioning the yarn to insure a uniform feed in length and elastic properties in the fabric structure. However, tensioning also requires capital investment and maintenance.

Moreover, it is often desirable to use yarns which have not been relaxed during spinning at all. This retains the maximum shrinkage, both recoverable and non-recoverable, in the biconstituent filaments, providing for optimum stretch and bulking potential in the composite yarn.

Thus, there is a continuing need to provide yarns and articles therefrom, that exhibit desired stretch and recovery properties, and in particular, yarns which have not been fully relaxed prior to making fabrics and articles therefrom. It is also desirable to design a process for making yarns with desired stretch and recovery properties which does not require tensioning.

SUMMARY OF THE INVENTION

While 100% biconstituent yarn can be useful, the economics and the stretch recovery properties of the biconstituents will often show best in composite yarns and fabrics. In many fabrics a content of 10–50% is adequate to provide useful stretch recovery properties, and other tactile and aesthetic benefits. The yarn of the present invention fulfills the continuing need to provide yarns and articles therefrom that exhibit desired stretch and recovery properties, and also overcomes the problems associated with relaxed, high stretch biconstituent filament yarns of the prior art. The present invention achieves this by providing a hetero-yarn where the biconstituent filament yarns are pre-combined with a companion yarn in a unitary yarn structure. Such hetero-yarn does not require relaxation in order to handle the yarn prior to making a fabric. Rather, the "elastic potential" of the hetero yarns of the present invention is integrated at the biconstituent processing stage. These hetero-yarns can be treated as hard yarns in fabric manufacture. The elastic potential is activated in the finishing of the fabric. In addition, s/z twist control is not required.

The hetero yarn of the present invention overcomes many of the drawbacks of Ishii in particular. For instance, the hetero-yarn of the present invention avoids heat cross-linking or heat relaxing the yarn prior to use. This is an advantage over Ishii, which preferred a two-step thermal cross-linking process. The hetero yarn of the present invention also avoids the need for tensioning, as preferred in Ishii, by feeding the biconstituent yarn in the hard yarn state. As noted above, tensioning requires capital investment and maintenance. Feeding the biconstituent in the hard yarn state is therefore more economical and reliable than the process described in Ishii, providing yarn properties are consistent.

In many cases high shrinkage can be accommodated in fabrication or used to an advantage, and the present invention makes use of this. Applicants have found that greige fabric and garment constructions from the yarn of the present invention can be adjusted to allow for the extra shrinkage. Further, high shrinkage can be used to an advantage in many fabric constructions, for instance to increase fabric bulk in hetero yarn structures, or to reduce or control knit fabric porosity in bottomweight knits. Also, yarns slightly relaxed on the face plate during spinning (5%–20%) substantially reduce non-recoverable shrinkage in finishing and enhance yarn toughness for knitting, while substantially retaining hard yarn package delivery characteristics.

Moreover, the co-mingling and co-texturing of yarns is more productive where two yarns to be co-mingled and co-textured have similar properties. In the present invention, the biconstituent yarn in the drawn pre-relaxed state has properties similar to the hard companion yarns, and very different from standard elastomeric fibers. Thus, the biconstituent yarn of the present invention can be air textured or air mingled efficiently with other hard companion yarns.

With the present invention, premature shrinkage can be controlled by proper package formation and package hardness. Applicants have found that it is possible to wind large packages of monofilament biconstituent in the unactivated state, and to store them for several months without significant loss of properties or change in package hardness.

In addition, the high shrinkage associated with biconstituent filaments requires that, on shrinking, the lower shrink companion yarn must bulk. The present invention envisions that either straight or textured companion yarns may be combined with biconstituent yarns. Straight companion yarns will tend to form loops which can be advantageous in some fabrics (say formation a terry surface fabric) or a negative in other cases (may increase fabric picking). However, companion yarns which have been cubicly crimped, or textured, have natural bends for storage of the added bulk when the biconstituent filaments shrink; biconstituent yarns with textured companion yarns have smoother or cotton-like surfaces which are often advantageous in many apparel applications.

The above-mentioned advantages are obtained by the present invention, which provides a hetero-composite yarn comprising a combined biconstituent yarn and a companion yarn, wherein the biconstituent yarn comprises at least one biconstituent filament including an axial core comprising a thermoplastic, elastomeric polymer and a plurality of wings attached to the core and comprising a thermoplastic, non-elastomeric polymer.

The above-mentioned advantages are also obtained by the present invention which provides a process for making a hetero-composite yarn, comprising spinning a biconstituent yarn and a companion yarn together, wherein the biconstituent yarn comprises at least one biconstituent filament including an axial core comprising a thermoplastic, elastomeric polymer and a plurality of wings attached to the core and comprising a thermoplastic, non-elastomeric polymer.

DETAILED DESCRIPTION OF PREFERRED EMBODIMENTS

Figure 1:
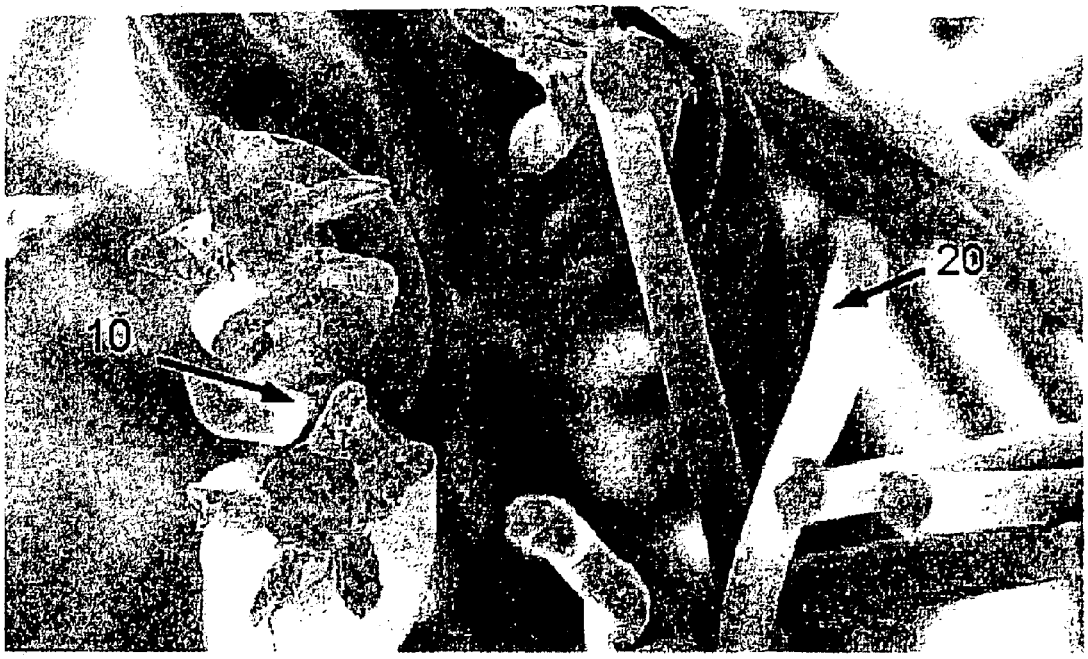
FIG. 1 is a representation of a hetero-composite-composite-yarn of the present invention.
Figure 2:
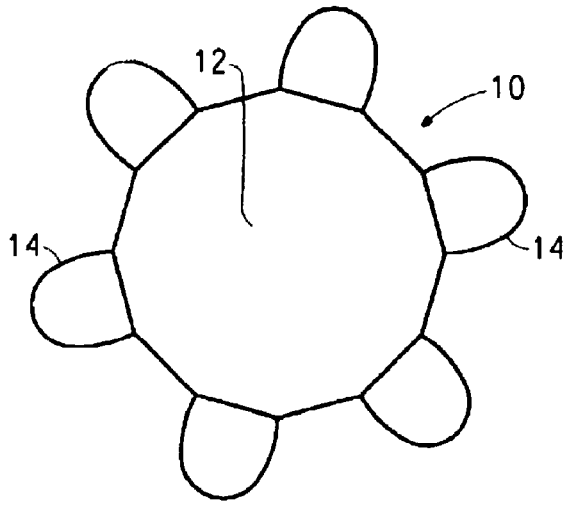
FIG. 2 is a schematic cross-section of a fiber of the invention.
Figure 3:
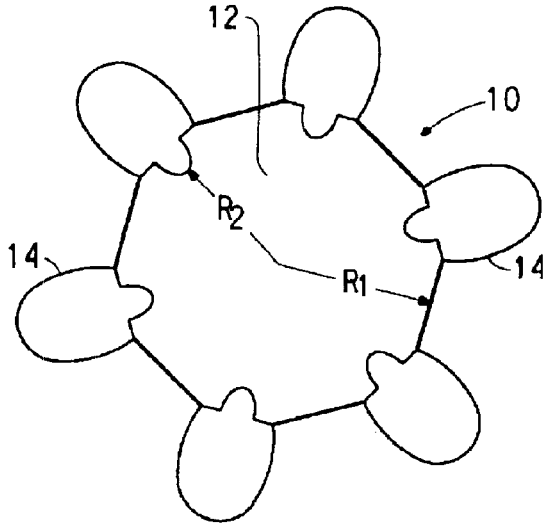
FIG. 3 is a schematic cross-section of a fiber of the invention with the wing polymer protruding into the core.
Figure 4:
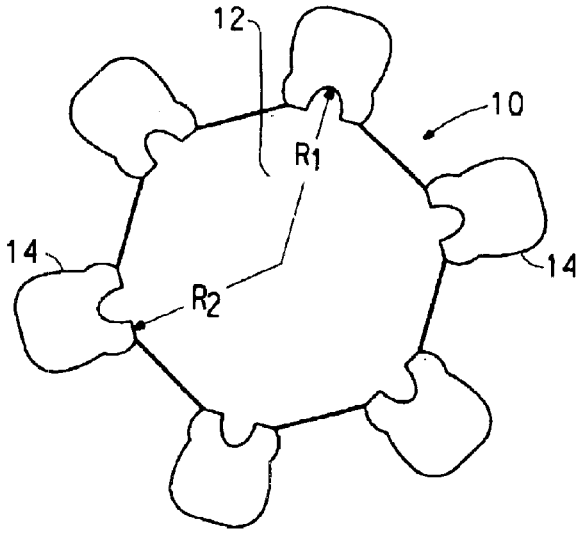
FIG. 4 is a schematic cross-section of a fiber of the invention with the core polymer protruding into the wings.

In accordance with the present invention, there is provided a hetero-composite yarn comprising a combined biconstituent yarn and companion yarn. FIG. 1 is a representation of a micrograph taken of the hetero-composite combination yarn of invention in side section. The biconstituent yarn is shown at 10 in FIG. 1, and the companion yarn is shown at 20 in FIG. 2. FIGS. 2–4 are cross-sectional profiles of a biconstituent fiber. The biconstituent yarn comprises at least one filament, shown generally at 10 in FIGS. 1–4, with an axial core, shown at 12 and a plurality of wings, shown at 14 in FIGS. 2–4, attached to the core. The axial core comprises a thermoplastic elastomeric polymer, the wings comprise at least one thermoplastic, non-elastomeric polymer attached to the core. Preferably, the thermoplastic, non-elastomeric polymer is permanently drawable.

As used herein, the term "fiber" is interchangeable with the term "filament". The term "yarn" includes yarns of a single filament. The term "multifilament yarn" generally relates to yarns of two or more filaments. The term "thermoplastic" refers to a polymer which can be repeatedly melt-processed (for example melt-spun). By 'elastomeric polymer' is meant a polymer which in monocomponent fiber form, free of diluents, has a break elongation in excess of 100% and which when stretched to twice its length, held for one minute, and then released, retracts to less than 1.5 times its original length within one minute of being released. The elastomeric polymers in the fiber of the invention can have a flex modulus of less than about 14,000 pounds per square inch (96,500 kPascals), more typically less than about 8500 pounds per square inch (58,600 kPascals) when present in a monocomponent fiber spun at 23° C. and under conditions substantially as described herein. As used herein, "non-elastomeric polymer" means any polymer which is not an elastomeric polymer. Such polymers can also be termed "low elasticity", "hard: and "high modulus". By "permanently drawable" is meant that the polymer has a yield point, and if the polymer is stretched beyond such point it will not return to its original length.

The fibers of the invention are termed "biconstituent" fibers when they are comprised of at least two polymers adhered to each other along the length of the fiber, each polymer being in a different generic class, e.g., polyamide, polyester or polyolefin. If the elastic characteristics of the polymers are sufficiently different, polymers of the same generic class can be used, and the resulting fiber is a "bicomponent" fiber. Such bicomponent fibers are also within the scope of the invention.

According to the invention, at least one of the wing polymer and the core polymer protrudes into the other polymer. FIG. 3 shows the wing polymer protruding into the core polymer, and FIG. 4 shows the core polymer protruding into the wing polymer. The penetration of core and wing polymers can be accomplished by any method effective for reducing splitting of the fiber. For example, in one embodiment, the penetrating polymer (for example the wing polymer) can protrude into the penetrated polymer (for example the core polymer) like the roots of a tooth, so that a plurality of protrusions are formed. In another embodiment, the penetrating polymer (for example the core polymer) can protrude so far into the penetrated polymer (for example the wing polymer), that the penetrating polymer is like a spline. A spline has substantively uniform diameter. In yet another embodiment, at least one polymer can have at least one protruding portion, of a single wing into core or core into wing, which includes a remote enlarged end section and a reduced neck section joining the end section to the remainder of the at least one polymer to form at least one necked-down portion therein. Wings and core attached to each other by such an enlarged end section and reduced neck section are referred to as 'mechanically locked'. For ease of manufacture and more effective adhesion between wings and core, the last-mentioned embodiment having a reduced neck section is often preferred. Other protrusion methods can be envisioned by those skilled in the art. For example, the core can surround a portion of the side of one or more wings, such that a wing penetrates the core.

The fiber of the invention includes an axial core with an outer radius and an inner radius (for example "$R_1$" and "$R_2$", respectively, in FIGS. 3 and 4). The outer radius is that of a circle circumscribing the outermost portions of the core, and the inner radius is that of a circle inscribing the innermost portions of the wings. In the fibers of the invention, $R_1/R_2$ is generally greater than about 1.2. It is preferred that $R_1/R_2$ be in the range of about 1.3 to about 2.0. Resistance to delamination can decline at lower ratios, and at higher ratios the high levels of elastomeric polymer in the wings (or of non-elastomeric polymer in the core) can decrease the stretch and recovery of the fiber. When the core forms a spline within the wing, $R_1/R_2$ approaches 2. In contrast, in a fiber where one of the wing or core polymer does not protrude into the other polymer, $R_1$ approximates $R_2$, so that neither wings nor core penetrate the other. In cases in which among the plurality of wings, the polymer in some wings penetrates the core polymer while the polymer in other wings is penetrated by the core polymer, $R_1$ and $R_2$ are determined only as pairs corresponding to each wing, and each ratio $R_1/R_2$ and $R_1'/R_2'$ is generally greater than about 1.2, preferably in the range of about 1.3 to 2.0. In another embodiment, some wings can be penetrated by core polymer while adjacent wings are not penetrated, and $R_1$ and $R_2$ are determined in relationship to penetrated wings; similarly, $R_1$ and $R_2$ are determined in relationship to penetrating wings when only some parts of the core are penetrated by wing polymer. Any combination of core into wing, wing into core, and no penetration can be used for the wings so long as at least one wing penetrates core or is penetrated by core.

The fiber of the present invention is twisted around its longitudinal axis, without significant two- or three-dimensional crimping characteristics. (In such higher-dimensional crimping, a fiber's longitudinal axis itself assumes a zig-zag or helical configuration; such fibers are not of the invention). The fiber of the present invention may be characterized as having substantially spiral twist and one dimensional spiral twist. "Substantially spiral twist" includes both spiral twist that passes completely around the elastomeric core and also spiral twist that passes only partly around the core, since it has been observed that a fully 360° spiral twist is not necessary to achieve the desirable stretch properties in the fiber. The substantially spiral twist can be either almost completely circumferential, or almost completely noncircumferential. "One dimensional" spiral twist means that while the wings of the fiber can be substantially spiral, the axis of the fiber is substantially straight even at low tension, in contrast to fibers having 2- or 3-dimensional crimp. However, fibers having some waviness are within the scope of the invention.

The presence or absence of two- and three-dimensional crimp can be gauged from the amount of stretch needed to substantially straighten the fiber (by pulling out any non-linearities) and is a measure of the radial symmetry of fibers having spiral twist. The fiber of the invention can require less than about 10% stretch, more typically less than about 7% stretch, for example about 4% to about 6%, to substantially straighten the fiber.

The fiber of the present invention has a substantially radially symmetric cross-section, as can be seen from FIGS. 1–4. By "substantially radially symmetric cross-section" is meant a cross-section in which the wings are located and are of dimensions so that rotation of the fiber about its longitudinal axis by 360/n degrees, in which "n" is an integer representing the "n-fold" symmetry of the fibers, results in substantially the same cross-section as before rotation. The cross-section is substantially symmetrical in terms of size, polymer and angular spacing around the core. This substantially radially symmetric cross-section impartes an unexpected combination of high stretch and high uniformity without significant levels of two- or three-dimensional crimp. Such uniformity is advantageous in high-speed processing of fibers, for example through guides and knitting needles, and in making smooth, non-'picky' fabrics, especially sheer fabrics like hosiery. Fibers which have a substantially radially symmetric cross-section possess no self-crimping potential, i.e., they have no significant two- or three-dimensional crimping characteristics. See generally *Textile Research Journal*, June 1967, p. 449.

Figure 5:
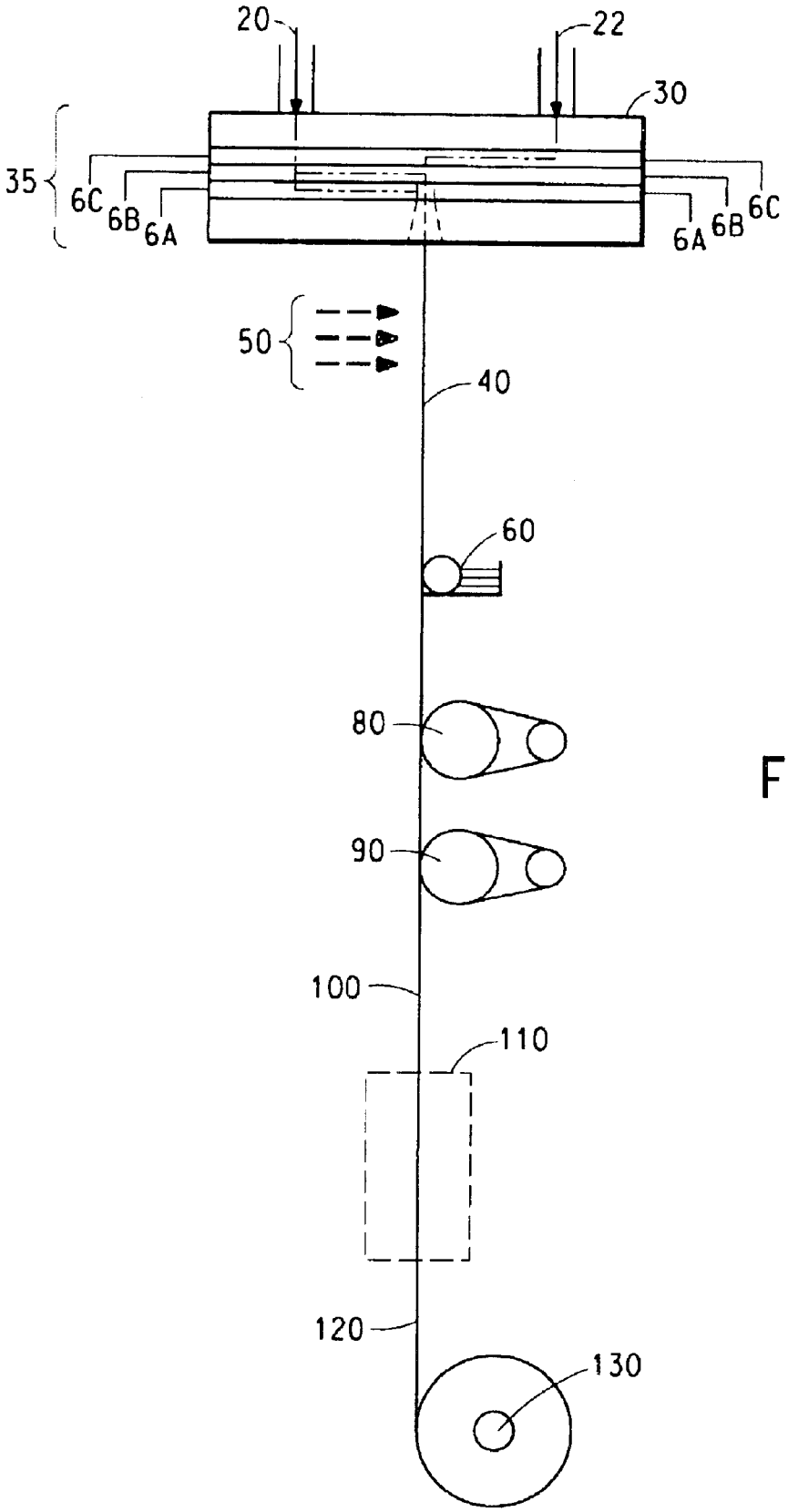
FIG. 5 is a process schematic apparatus useful for making fibers of this invention.

For maximum cross-sectional radial symmetry, the core can have a substantially circular or a regular polyhedral cross-section, e.g., as seen in FIGS. 1–4. By "substantially circular" it is meant that the ratio of the lengths of two axes crossing each other at 90° in the center of the fiber cross-section is no greater than about 1.2:1. The use of a substantially circular or regular polyhedron core, in contrast to the cores of U.S. Pat. No. 4,861,660, can protect the elastomer from contact with the rolls, guides, etc. as described later with reference to the number of wings. The plurality of wings can be arranged in any desired manner around the core, for example, discontinuously as depicted in FIGS. 1 and 2, i.e., the wing polymer does not form a continous mantel on the core, or with adjacent wing(s) meeting at the core surface, e.g., as illustrated in FIGS. 4 and 5 of U.S. Pat. No. 3,418,200. The wings can be of the same or different sizes, provided a substantially radial symmetry is preserved. Further, each wing can be of a different polymer from the other wings, once again provided substantially radial geometric and polymer composition symmetry is maintained. However, for simplicity of manufacture and ease of attaining radial symmetry, it is preferred that the wings be of approximately the same dimensions, and be made of the same polymer or blend of polymers. It is also preferred that the wings discontinuously surround the core for ease of manufacture.

While the fiber cross-section is substantially symmetrical in terms of size, polymer, and angular spacing around the core, it is understood that small variations from perfect symmetry generally occur in any spinning process due to such factors as non-uniform quenching or imperfect polymer melt flow or imperfect spinning orifices. It is to be understood that such variations are permissible provided that they are not of a sufficient extent to detract from the objects of the invention, such as providing fibers of desired stretch and recovery via one-dimensional spiral twist, while minimizing two- and three-dimensional crimping. That is, the fiber is not intentionally made asymmetrical as in U.S. Pat. No. 4,861,660.

The wings protrude outward from the core to which they adhere and form a plurality of spirals at least part way around the core especially after effective heating. The pitch of such spirals can increase when the fiber is stretched. The fiber of the invention has a plurality of wings, preferably 3–8, more preferably 5 or 6. The number of wings used can depend on other features of the fiber and the conditions under which it will be made and used. For example, 5 or 6 wings can be used when a monofilament is being made, especially at higher draw ratios and fiber tensions. In this case the wing spacing can be frequent enough around the core that the elastomer is protected from contact with rolls, guides, and the like and therefore less subject to breaks, roll wraps and wear than if fewer wings were used. The effect of higher draw ratios and fiber tensions is to press the fiber harder against rolls and guides, thus splaying out the wings and bringing the elastomeric core into contact with the roll or guide; hence the preference for more than two wings at high draw ratios and fiber tensions. In monofilaments, five or six wings are often preferred for an optimum combination of ease of manufacture and reduced core contact. When a multifiber yarn is desired, as few as two or three wings can be used because the likelihood of contact between the elastomeric core and rolls or guides is reduced by the presence of the other fibers.

While it is preferred that the wings discontinuously surround the core for ease of manufacture, the core may include on its outside surface a sheath of a non-elastomeric polymer between points where the wings contact the core. The sheath thickness can be in the range of about 0.5% to about 15% of the largest radius of the fiber core. The sheath can help with adhesion of the wings to the core by providing more contact points between the core and wing polymers, a particularly useful feature if the polymers in the biconstituent fiber do not adhere well to each other. The sheath can also reduce abrasive contact between the core and rolls, guides, and the like, especially when the fiber has a low number of wings.

The core and/or wings of the multiwinged cross-section of the present invention may be solid or include hollows or voids. Typically, the core and wings are both solid. Moreover, the wings may have any shape, such as ovals, T-, C-, or S-shapes. Examples of useful wing shapes are found in U.S. Pat. No. 4,385,886. T, C, or S shapes can help protect the elastomer core from contact with guides and rolls as described previously.

The weight ratio of total wing polymer to core polymer can be varied to impart the desired mix of properties, e.g., desired elasticity from the core and other properties such as low tackiness from the wing polymer. For example, a weight ratio of about 10/90 to about 70/30, preferably about 30/70 to about 40/60 of wing to core can be used. For high durability combined with high stretch in uses in which the fiber need not be used with a companion yarn (for example hosiery), a wing/core weight ratio of about 35/65 to about 50/50 is preferred. For best adhesion between the core and wings, typically about 5 wt % to about 30 wt % of the total fiber weight can be non-elastic polymer penetrating the core, or elastic core polymer penetrating the wings.

As noted above, the core of the fiber of the invention can be formed from any thermoplastic elastomeric polymer. Examples of useful elastomers include thermoplastic polyurethanes, thermoplastic polyester elastomers, thermoplastic polyolefins, thermoplastic polyesteramide elastomers and thermoplastic polyetheresteramide elastomers.

Useful thermoplastic polyurethane core elastomers include those prepared from a polymeric glycol, a diisocyanate, and at least one diol or diamine chain extender. Diol chain extenders are preferred because the polyurethanes made therewith have lower melting points than if a diamine chain extender were used. Polymeric glycols useful in the preparation of the elastomeric polyurethanes include polyether glycols, polyester glycols, polycarbonate glycols and copolymers thereof. Examples of such glycols include poly(ethyleneether) glycol, poly(tetramethyleneether) glycol, poly(tetramethylene-co-2-methyl-tetramethyleneether) glycol, poly(ethylene-co-1,4-butylene adipate) glycol, poly(ethylene-co-1,2-propylene adipate) glycol, poly(hexamethylene-co-2,2-dimethyl-1,3-propylene adipate), poly(3-methyl-1,5-pentylene adipate) glycol, poly (3-methyl-1,5-pentylene nonanoate) glycol, poly(2,2-dimethyl-1,3-propylene dodecanoate) glycol, poly(pentane-1,5-carbonate) glycol, and poly(hexane-1,6-carbonate) glycol. Useful diisocyanates include 1-isocyanato-4-[(4-isocyanatophenyl)methyl]benzene, 1-isocyanato-2-[(4-isocyanato-phenyl)methyl]benzene, isophorone diisocyanate, 1,6-hexanediisocyanate, 2,2-bis(4-isocyanatophenyl)propane, 1,4-bis(p-isocyanato,alpha, alpha-dimethylbenzyl)benzene, 1,1'-methylenebis(4-isocyanatocyclohexane), and 2,4-tolylene diisocyanate. Useful diol chain extenders include ethylene glycol, 1,3 propane diol, 1,4-butanediol, 2,2-dimethyl-1,3-propylene diol, diethylene glycol, and mixtures thereof. Preferred polymeric glycols are poly(tetramethyleneether) glycol, poly(tetramethylene-co-2-methyl-tetramethyleneether) glycol, poly(ethylene-co-1,4-butylene adipate) glycol, and poly(2,2-dimethyl-1,3-propylene dodecanoate) glycol. 1-Isocyanato-4-[(4-isocyanatophenyl)methyl]benzene is a preferred diisocyanate. Preferred diol chain extenders are 1,3 propane diol and 1,4-butanediol. Monofunctional chain terminators such as 1-butanol and the like can be added to control the molecular weight of the polymer.

Useful thermoplastic polyester elastomers include the polyetheresters made by the reaction of a polyether glycol with a low-molecular weight diol, for example, a molecular weight of less than about 250, and a dicarboxylic acid or diester thereof, for example, terephthalic acid or dimethyl terephthalate. Useful polyether glycols include poly (ethyleneether) glycol, poly(tetramethyleneether) glycol, poly(tetramethylene-co-2-methyltetramethyleneether) glycol [derived from the copolymerization of tetrahydrofuran and 3-methyltetrahydrofuran] and poly(ethylene-co-tetramethyleneether) glycol. Useful low-molecular weight diols include ethylene glycol, 1,3 propane diol, 1,4-butanediol, 2,2-dimethyl-1,3-propylene diol, and mixtures thereof; 1,3 propane diol and 1,4-butanediol are preferred. Useful dicarboxylic acids include terephthalic acid, optionally with minor amounts of isophthalic acid, and diesters thereof (e.g., <20 mol %).

Useful thermoplastic polyesteramide elastomers that can be used in making the core of the fibers of the invention include those described in U.S. Pat. No. 3,468,975. For example, such elastomers can be prepared with polyester segments made by the reaction of ethylene glycol, 1,2-propanediol, 1,3-propanediol, 1,4-butanediol, 2,2-dimethyl-1,3-propanediol, 1,5-pentanediol, 1,6-hexanediol, 1,10-decandiol, 1,4-di(methylol)cyclohexane, diethylene glycol, or triethylene glycol with malonic acid, succinic acid, glutaric acid, adipic acid, 2-methyladipic acid, 3-methyladipic acid, 3,4-dimethyladipic acid, pimelic acid, suberic acid, azelaic acid, sebacic acid, or dodecandioic acid, or esters thereof. Examples of polyamide segments in such polyesteramides include those prepared by the reaction of hexamethylene diamine or dodecamethylene diamine with terephthalic acid, oxalic acid, adipic acid, or sebacic acid, and by the ring-opening polymerization of caprolactam.

Thermoplastic polyetheresteramide elastomers, such as those described in U.S. Pat. No. 4,230,838, can also be used to make the fiber core. Such elastomers can be prepared, for example, by preparing a dicarboxylic acid-terminated polyamide prepolymer from a low molecular weight (for example, about 300 to about 15,000) polycaprolactam, polyoenantholactam, polydodecanolactam, polyundecanolactam, poly(11-aminoundecanoic acid), poly(12-aminododecanoic acid), poly(hexamethylene adipate), poly(hexamethylene azelate), poly(hexamethylene sebacate), poly(hexamethylene undecanoate), poly(hexamethylene dodecanoate), poly(nonamethylene adipate), or the like and succinic acid, adipic acid, suberic acid, azelaic acid, sebacic acid, undecanedioic acid, terephthalic acid, dodecanedioic acid, or the like. The prepolymer can then be reacted with an hydroxy-terminated polyether, for example poly(tetramethylene ether) glycol, poly(tetramethylene-co-2-methyltetramethylene ether) glycol, poly(propylene ether) glycol, poly(ethylene ether) glycol, or the like.

As noted above, the wings can be formed from any non-elastomeric, or hard, polymer. Examples of such polymers include non-elastomeric polyesters, polyamides, and polyolefins.

Useful thermoplastic non-elastomeric wing polyesters include poly(ethylene terephthalate) ("2G-T") and copolymers thereof, poly(trimethylene terephthalate) ("3G-T"), polybutylene terephthalate ("4G-T"), and poly(ethylene 2,6-naphthalate), poly(1,4-cyclohexylenedimethylene terephthalate), poly(lactide), poly(ethylene azelate), poly[ethylene-2,7-naphthalate], poly(glycolic acid), poly(ethylene succinate), poly(.alpha.,.alpha.-dimethylpropiolactone), poly(para-hydroxybenzoate), poly(ethylene oxybenzoate), poly(ethylene isophthalate), poly(tetramethylene terephthalate, poly(hexamethylene terephthalate), poly(decamethylene terephthalate), poly(1,4-cyclohexane dimethylene terephthalate) (trans), poly(ethylene 1,5-naphthalate), poly(ethylene 2,6-naphthalate), poly(1,4-cyclohexylidene dimethylene terephthalate)(cis), and poly(1,4-cyclohexylidene dimethylene terephthalate) (trans).

Preferred non-elastomeric polyesters include poly(ethylene terephthalate), poly(trimethylene terephthalate), and poly(1,4-butylene terephthalate) and copolymers thereof. When a relatively high-melting polyesters such as poly(ethylene terephthalate) is used, a comonomer can be incorporated into the polyester so that it can be spun at reduced temperatures. Such comonomers can include linear, cyclic, and branched aliphatic dicarboxylic acids having 4–12 carbon atoms (for example pentanedioic acid); aromatic dicarboxylic acids other than terephthalic acid and having 8–12 carbon atoms (for example isophthalic acid); linear, cyclic, and branched aliphatic diols having 3–8 carbon atoms (for example 1,3-propane diol, 1,2-propanediol, 1,4-butanediol, and 2,2-dimethyl-1,3-propanediol); and aliphatic and araliphatic ether glycols having 4–10 carbon atoms (for example hydroquinone bis(2-hydroxyethyl) ether). The comonomer can be present in the copolyester at a level in the range of about 0.5 to 15 mole percent. Isophthalic acid, pentanedioic acid, hexanedioic acid, 1,3-propane diol, and 1,4-butanediol are preferred comonomers for poly(ethylene terephthalate) because they are readily commercially available and inexpensive.

The wing polyester(s) can also contain minor amounts of other comonomers, provided such comonomers do not have an adverse affect on fiber properties. Such other comonomers include 5-sodium-sulfoisophthalate, for example, at a level in the range of about 0.2 to 5 mole percent. Very small amounts, for example, about 0.1 wt % to about 0.5 wt % based on total ingredients, of trifunctional comonomers, for example trimellitic acid, can be incorporated for viscosity control.

Useful thermoplastic non-elastomeric wing polyamides include poly(hexamethylene adipamide) (nylon 6,6); polycaprolactam (nylon 6); polyenanthamide (nylon 7); nylon 10; poly(12-dodecanolactam) (nylon 12); polytetramethyleneadipamide (nylon 4,6); polyhexamethylene sebacamide (nylon 6,10); poly(hexamethylene dodecanamide) (nylon 6,12); the polyamide of dodecamethylenediamine and n-dodecanedioic acid (nylon 12,12), PACM-12 polyamide derived from bis(4-aminocyclohexyl)methane and dodecanedioic acid, the copolyamide of 30% hexamethylene diammonium isophthalate and 70% hexamethylene diammonium adipate, the copolyamide of up to 30% bis-(P-amidocyclohexyl)methylene, and terephthalic acid and caprolactam, poly(4-aminobutyric acid) (nylon 4), poly(8-aminooctanoic acid) (nylon 8), poly(hapta-methylene pimelamide) (nylon 7,7), poly(octamethylene suberamide) (nylon 8,8), poly(nonamethylene azelamide) (nylon 9,9), poly(decamethylene azelamide) (nylon 10,9), poly(decamethylene sebacamide (nylon 10,10), poly[bis(4-amino-cyclohexyl)methane-1,10-decanedicarboxamide], poly(m-xylene adipamide), poly(p-xylene sebacamide), poly(2,2,2-trimethylhexamethylene pimelamide), poly(piperazine sebacamide), poly(11-amino-undecanoic acid) (nylon 11), polyhexamethylene isophthalamide, polyhexamethylene terephthalamide, and poly(9-aminononanoic acid) (nylon 9) polycaproamide. Copolyamides can also be used, for example poly(hexamethylene-co-2-methylpentamethylene adipamide) in which the hexamethylene moiety can be present at about 75–90 mol % of total diamine-derived moieties.

Useful polyolefins include polypropylene, polyethylene, polymethylpentane and copolymers and terpolymers of one or more of ethylene or propylene with other unsaturated monomers. For example, fibers comprising non-elastomeric polypropylene wings and an elastomeric polypropylene core are within the scope of the present invention; such fibers are bicomponent fibers.

Combinations of elastomeric and non-elastomeric polymers can include a polyetheramide, for example, a polyetheresteramide, elastomer core with polyamide wings and a polyetherester elastomer core with polyester wings. For example a wing polymer can comprise nylon 6—6, and copolymers thereof, for example, poly(hexamethylene-co-2-methylpentamethylene adipamide) in which the hexamethylene moiety is present at about 80 mol % optionally mixed with about 1% up to about 15% by weight of nylon-12, and a core polymer can comprise an elastomeric segmented polyetheresteramide. "Segmented polyetheresteramide" means a polymer having soft segments (long-chain polyether) covalently bound (by the ester groups) to hard segments (short-chain polyamides). Similar definitions correspond to segmented polyetherester, segmented polyurethane, and the like. The nylon 12 can improve the wing adhesion to the core, especially when the core is based on PEBAX™ 3533SN from Atofina. Another preferred wing polymer can comprise a non-elastomeric polyester selected from the group of poly(ethylene terephthalate) and copolymers thereof, poly(trimethylene terephthalate), and poly (tetramethylene terephthalate); an elastomeric core suitable for use therewith can comprise a polyetherester comprising the reaction product of a polyether glycol selected from the group of poly(tetramethyleneether) glycol and poly (tetramethylene-co-2-methyl-tetramethyleneether) glycol with terephthalic acid or dimethyl terephthalate and a low molecular weight diol selected from the group of 1,3-propane diol and 1,4-butane diol.

An elastomeric polyetherester core can also be used with non-elastomeric polyamide wings, especially when an adhesion-promoting additive is used, as described elsewhere herein. For example, the wings of such a fiber can be selected from the group of (a) poly(hexamethylene adipamide) and copolymers thereof with 2-methylpentamethylene diamine and (b) polycaprolactam, and the core of such a fiber can be selected from the group of (a) polyetheresteramide and (b) the reaction products of poly(tetramethyleneether) glycol or poly(tetramethylene-co-2-methyltetramethyleneether) glycol with terphthalic acid or dimethyl terephthalate and a diol selected from the group of 1,3-propane diol and 1,4-butene diol.

Methods of making the polymers described above are known in the art and may include the use of catalysts, co-catalysts, and chain-branchers, as known in the art.

The high elasticity of the core permits it to absorb compressional and extensional forces as it is twisted by the attached wings when the fiber is stretched and relaxed. These forces can cause delamination of the two polymers if their attachment is too weak. The present invention optionally uses a mechanical locking of the wing and core polymers to enhance the attachment, and further minimize delamination, upon fiber processing and use. Bonding between the core and wings can be even further enhanced by selection of the wing and core compositions and/or the use of adhesion-promoting additives to either or both polymers. An adhesion promoter can be used in each or only some of the wings. Thus, individual wings can have different degrees of lamination to the core, e.g., some of the wings can be made to intentionally delaminate. One example of such additive is nylon 12, e.g., 5% by weight, based on total wing polymer, i.e., poly(12-dodecanolactam), also known as "12" or "N12", commercially available as Rilsan® "AMNO" from Atofina. Also, maleic anhydride derivatives (for example Bynel® CXA, a registered trademark of E. I. du Pont de Nemours and Company or Lotader® ethylene/acrylic ester/maleic anhydride terpolymers from Atofina) can be used to modify a polyether-amide elastomer to improve it adhesion to a polyamide.

As another example, a thermoplastic novolac resin, for example HRJ12700 (Schenectady International), having a number average molecular weight in the range of about 400 to about 5000, could be added to an elastomeric (co) polyetherester core to improve its adhesion to (co)polyamide wings. The amount of novolac resin should be in the range of 1–20 wt %, with a more preferred range of 2–10 wt %. Examples of the novolac resins useful herein include, but are not limited to, phenol-formaldehyde, resorcinol-formaldehyde, p-butylphenol-formaldehyde, p-ethylphenol-formaldehyde, p-hexylphenol-formaldehyde, p-propylphenol-formaldehyde, p-pentylphenol-formaldehyde, p-octylphenol-formaldehyde, p-heptylphenol-formaldehyde, p-nonylphenol-formaldehyde, bisphenol-A-formaldehyde, hydroxynapthaleneformaldehyde and alkyl-(such as t-butyl-) phenol modified ester (such as penterythritol ester) of rosin (particularly partially maleated rosin). See allowed U.S. patent application Ser. No. 09/384,605, filed Aug. 27, 1999 for examples of techniques to provide improved adhesion between copolyester elastomers and polyamide.

Polyesters functionalized with maleic anhydride ("MA") could also be used as adhesion-promoting additives. For, example, poly(butylene terephthalate) ("PBT") can be functionalized with MA by free radical grafting in a twin screw extruder, according to J. M. Bhattacharya, *Polymer International* (August, 2000), 49: 8, pp. 860–866, incorporated by reference herein, who also reported that a few weight percent of the resulting PBT-g-MA was used as a compatibilizer for binary blends of poly(butylene terephthalate) with nylon 66 and poly(ethylene terephthalate) with nylon 66. For example, such an additive could be used to adhere more firmly (co)polyamide wings to a (co)polyetherester core of the fiber of the present invention.

The polymers and resultant fibers, yarns, and articles used in the present invention can comprise conventional additives, which are added during the polymerization process or to the formed polymer or article, and may contribute towards improving the polymer or fiber properties. Examples of these additives include antistatics, antioxidants, antimicrobials, flameproofing agents, dyestuffs, light stabilizers, polymerization catalysts and auxiliaries, adhesion promoters, delustrants, such as titanium dioxide, mafting agents, and organic phosphates.

Other additives that may be applied on the fibers, for example, during spinning and/or drawing processes include antistatics, slickening agents, adhesion promoters, hydrophilic agents antioxidants, antimicrobials, flameproofing agents, lubricants, and combinations thereof. Moreover, such additional additives may be added during various steps of the process as is known in the art.

While the above description focuses on advantages when the fiber has a substantially radially symmetric cross-section, such symmetry, while often desired, is not required for embodiments of the invention where:

(a) the stretchable synthetic polymer fiber has a delamination rating of less than about 1 and an after boil-off shrinkage of at least about 20%.

(b) the stretchable synthetic polymer fiber has at least about 20% after boil-off shrinkage and requires less than about 10% stretch to substantially straighten the fiber;

(c) the stretchable synthetic polymer fiber comprises an axial core comprising an elastomeric polymer and a plurality of wings comprising a non-elastomeric polymer attached to the core, wherein the core includes on its outside surface a sheath of a non-elastomeric polymer between points where the wings contact the core;

(d) the stretchable synthetic polymer fiber comprises an axial core comprising an elastomeric polymer and a plurality of wings comprising a non-elastomeric polymer attached to the core, wherein the core has a substantially circular or regular polyhedron cross section; or (e) the stretchable synthetic polymer fiber comprises an axial core comprising an elastomeric polymer and a plurality of wings comprising a non-elastomeric polymer attached to the core, wherein at least one of the wings has a T, C, or S shape.

The free biconstituent fibers (i.e., biconstituent fibers having little resistive force thereon) can have an after-boil-off stretch of at least about 20%, preferably of at least about 45% for improved comfort and fit in the final garment. The boil-off stretch of a fabric will depend on its construction, and the degree of constraint on the fiber in the fabric environment. Generally, the more of freedom from constraint and jamming the fiber sees in the fabric, the more stretch and recoery it can generate in fabric form.

The fibers of the invention can be in the form of continuous filament (either a multifilament yarn or a monofilament) or staple (including for example tow or spun yarn). The drawn fibers of the invention can have a denier per fiber of from about 1.5 to about 60 (about 1.7–67 dtex). Fully drawn fibers of the invention with polyamide wing typically have tenacities of about 1.5 to 3.0 g/dtex, and fibers with polyester wing, about 1–2.5 g/dtex, depending on wing/core ratios.

When a yarn comprising a plurality of fibers is made, the fibers can be of any desired fiber count and any desired dpf, and the ratios of the elastomeric to non-elastomeric polymers can differ from fiber to fiber. The multifilament yarn can contain a plurality of different fibers, for example, from 2 to 100 fibers. In addition, yarns comprising the fibers of the present invention can have a range of linear densities per fiber and can also comprise fibers not of the invention.

The process for making the biconstituent fibers of the present invention will be described with respect to FIG. 5, which is a schematic of an apparatus which can be used to make the fibers of the present invention. However, it should be understood that other apparatus may be used. The process of the present invention comprises passing a melt comprising an elastomeric polymer through a spinneret to form a plurality of stretchable synthetic polymeric fibers including an axial core comprising the elastomeric polymer and a plurality of wings attached to the core and comprising the non-elastomeric polymer. With reference to FIG. 5, a thermoplastic hard polymer supply, which is not shown, is introduced at 20 to a spin pack assembly 30, and a thermoplastic elastomeric polymer supply, which is not shown, is introduced at 22 to spin pack assembly 30. Precoalescence or post coalescence spinneret packs can be used. The two polymers can be extruded as undrawn filaments 40 from a stacked plate spinneret assembly 35 having orifices designed to give the desired cross section. The process of the present invention further includes quenching the filaments after they exit the capillary of the spinneret to cool the fibers in any known manner, for example by cool air at 50 in FIG. 5. Any suitable quenching method may be used, such as cross-flow air or radially flowing air.

The filaments are optionally treated with a finish, such as silicone oil optionally with magnesium stearate using any known technique at a finish applicator 60 as shown in FIG. 5. These filaments are then drawn, after quenching, so that they exhibit at least about 20% after boil-off stretch. The filaments may be drawn in at least one drawing step, for example between a feed roll 80 (which can be operated at 150 to 1000 meters/minute) and a draw roll 90 shown schematically in FIG. 5 to form a drawn filament 100. The drawing step can be coupled with spinning to make a fully-drawn yarn or, if a partially oriented yarn is desired, in a split process in which there is a delay between spinning and drawing. Drawing can also be accomplished during winding the filaments as a warp of yarns; called "draw warping" by those skilled in the art. Any desired draw ratio, (short of that which interferes with processing by breaking filament) can be imparted to the filament, for example, a fully oriented yarn can be produced by a draw ratio of about 3.0 to 4.5 times, and a partially oriented yarn produced by a draw ratio of about 1.2–3.0 times. Herein, draw ratio is the draw roll 90 peripheral speed divided by the feed roll 80 peripheral speed. Drawing can be carried out at about 15–100° C., typically about 15–40° C.

The drawn filament 100 optionally can be partly relaxed, for example, with steam at 110 in FIG. 5. Any amount of heat-relaxation can be carried out during spinning. The greater the relaxation, the more elastic the filament, and the less shrinkage that occurs in downstream operations. The drawn, final filament, after being relaxed as described below, can have at least about 20% after boil-off stretch. It is preferred to heat-relax the just-spun filament by about 1–35% based on the length of the drawn filaments before winding it up, so that it can be handled as a typical hard yarn.

The quenched, drawn, and optionally relaxed filaments can then be collected by winding at a speed of 200 to about 3500 meters per minute and up to 4000 meters per minute, at winder 130 in FIG. 5. Or if multiple fibers have been spun and quenched, the fibers can be converged, optionally interlaced, and then wound up for example at up to 4000 meters per minute at winder 130, for example in the range of about 200 to about 3500 meters per minute. Single filament or multifilament yarns may be wound up at winder 130 in FIG. 5, in the same manner. Where multiple filaments have been spun and quenched, the filaments can be converged and oprtionally interlaced prior to winding as is done in the art.

At any time after being drawn, the biconstituent filament may be dry- or wet-heattreated while fully relaxed to develop the desired stretch and recovery properties. Such relaxation can be accomplished during filament production, for example during the above-described relaxation step, or after the filament has been incorporated into a yarn or a fabric, for example during scouring, dyeing, and the like. Heat-treatment in fiber or yarn form can be carried out using hot rolls or a hot chest or in a jet-screen bulking step, for example. It is preferred that such relaxed heat-treatment be performed after the fiber is in a yarn or a fabric so that up to that time it can be processed like a non-elastomeric fiber; however, if desired, it can be heat-treated and fully relaxed before being wound up as a high-stretch fiber. For greater uniformity in the final fabric, the fiber can be uniformly heat-treated and relaxed. The heat-treating/relaxation temperature can be in the range of about 80° C. to about 120° C. when the heating medium is dry air, about 75° C. to about 100° C. when the heating medium is hot water, and about 101° C. to about 115° C. when the heating medium is superatmospheric pressure steam (for example in an autoclave). Lower temperatures can result in too little or no heat-treatment, and higher temperatures can melt the elastomeric core polymer. The heat-treating/relaxation step can generally be accomplished in a few seconds.

The biconstituent yarns can be wound up to hard yarns (non-elastic yarn), since the as spun, biconstituent yarn shows elongation and stretch properties consistent with their hard yarn lobe component. That is, the individual lobe portions about the elastomer core are generally straight and parallel to the filament direction as spun. Yarn or fabrics or other articles constructed from these yarns can be finished with heat. This heat treatment causes the lobe portions to spiral around the elastomer core. Substantial shrinkage of the biconstituent yarn takes place, as much as ⅓ to ½ of the filament spun length is reduced. As a result, there is development of a high level of stretch and recovery. The percent stretch of the yarn after finishing will be a function of the differential in shrinkage of the biconstituent and companion yarn since the biconstituent develops recoverable shrinkage (after boil-off stretch), but can only stretch to the point where the hard yarn is fully engaged. Stretch and recovery is evaluated subjectively by pulling on the fabrics and observing that the fabrics return to their original shape when the fabric is released.

As noted above, the spinneret capillary has a design corresponding to the desired cross-section of the fibers of the present invention, as described above, or to produce other biconstituent or bicomponent fibers. The capillaries or spinneret bore holes may be cut by any suitable method, such as by laser cutting, as described in U.S. Pat. No. 5,168,143, drilling, Electrical Discharge Machining (EDM), and punching, as is known in the art. The capillary orifice can be cut using a laser beam for good control of the cross-sectional symmetry of the fiber of the invention. The orifices of the spinneret capillary can have any suitable dimensions and can be cut to be continuous (pre-coalescence) or non-continuous (post-coalescence). A non-continuous capillary may be obtained by boring small holes in a pattern that would allow the polymer to coalesce below the spinneret face and form the multi-wing cross-section of the present invention.

Figure 6:
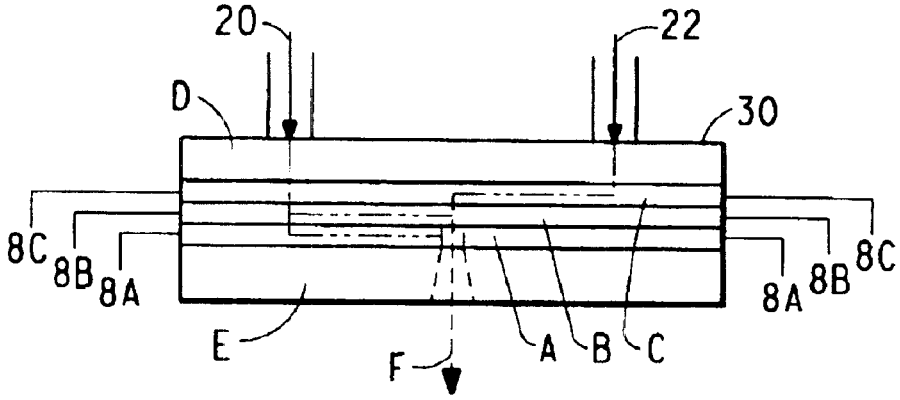
FIG. 6 is a representation of a stacked plate spinneret assembly, in side elevation, that can be used to make the fiber of the invention.

For example, the filaments of the invention can be made with a precoalescence spinneret pack as illustrated in FIGS. 6, 6A, 6B and 6C. In FIG. 6, a side elevation of the spinneret assembly stacked plates as shown in FIG. 5, the polymer flow is in the direction of arrow F. The first plate in the spinneret assembly is plate D containing the polymer melt pool and is of a conventional design. Plate D rests upon metering plate C (shown in cross sectional view FIG. 6C), which in turn rests upon optional distribution plate B (shown in cross sectional view FIG. 6B), which rests on spinneret plate A (shown in cross sectional view FIG. 6A), which is supported by spinneret assembly support plate E. Metering plate C is aligned and in contact with distribution plate B below the metering plate, the distribution plate being above, aligned with, and in contact with spinneret plate A having capillaries there through but lacking substantial counterbores, the spinneret plate(s) being aligned and in contact with a spinneret support plate (E) having holes larger than the capillaries. The alignments are such that a polymer fed to the metering plate C can pass through distribution plate B, spinneret plate A and spinneret support plate E to form a fiber. Melt pool plate D, which is a conventional plate, is used to feed the metering plate. The polymer melt pool plate D and spinneret assembly support plate E are sufficiently thick and rigid that they can be pressed firmly toward each other, thus preventing polymer from leaking between the stacked plates of the spinneret assembly. Plates A, B, and C are sufficiently thin that the orifices can be cut with laser light methods. It is preferred that the holes in the spinneret support plate (E) be flared, for example at about 45°–60°, so that the just-spun fiber does not contact the edges of the holes. It is also preferred that, when precoalescence of the polymers is desired, the polymers be in contact with each other (precoalescence) for less than about 0.30 cm, generally less than 0.15 cm, before the fiber is formed so that the cross-sectional shape intended by the metering plate C, optional distribution plate D, and spinneret plate design E is more accurately exhibited in the fiber. More precise definition of the fiber cross-section can also be aided by cutting the holes through the plates as described in U.S. Pat. No. 5,168,143, in which a multi-mode beam from a solid-state laser is reduced to a predominantly single-mode beam (for example $TM_{00}$ mode) and focused to a spot of less than 100 microns in diameter and 0.2 to 0.3 mm above the sheet of metal. The resulting molten metal is expelled from the lower surface of the metal sheet by a pressurized fluid flowing coaxially with the laser beam. The distance from the top of the uppermost distribution plate to the spinneret face can be reduced to less than about 0.30 cm.

Figure 6A:
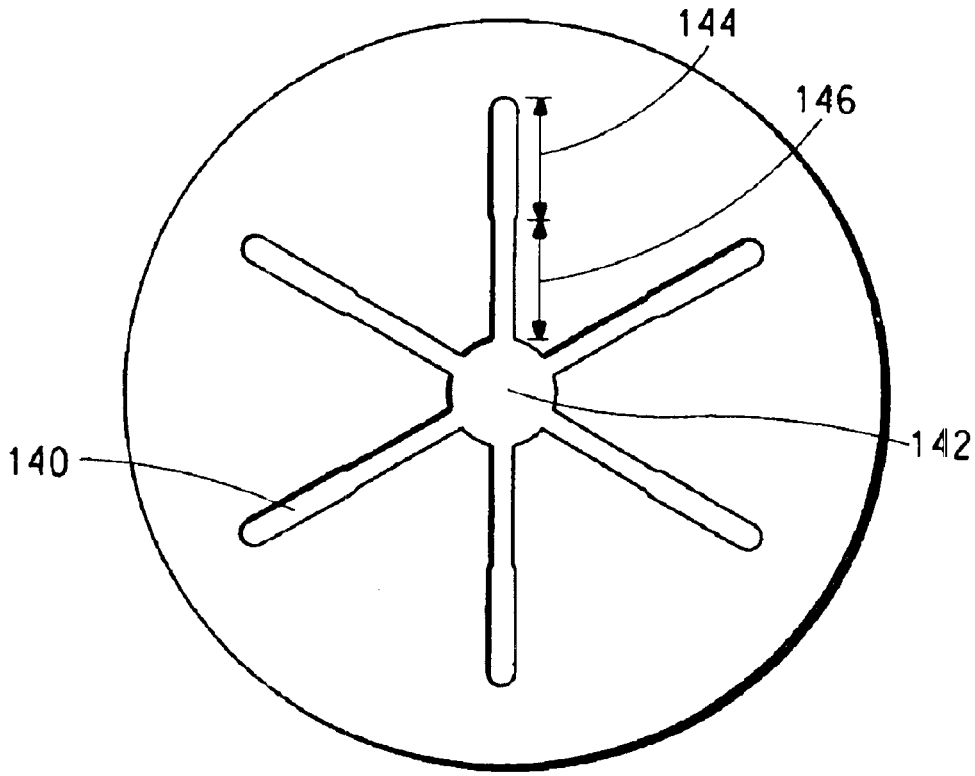
FIG. 6A is a representation of orifice Plate A in plan view at 90° to the stacked plate spinneret assembly shown in FIG. 6 and taken across lines 6A—6A of FIG. 6.
Figure 6B:
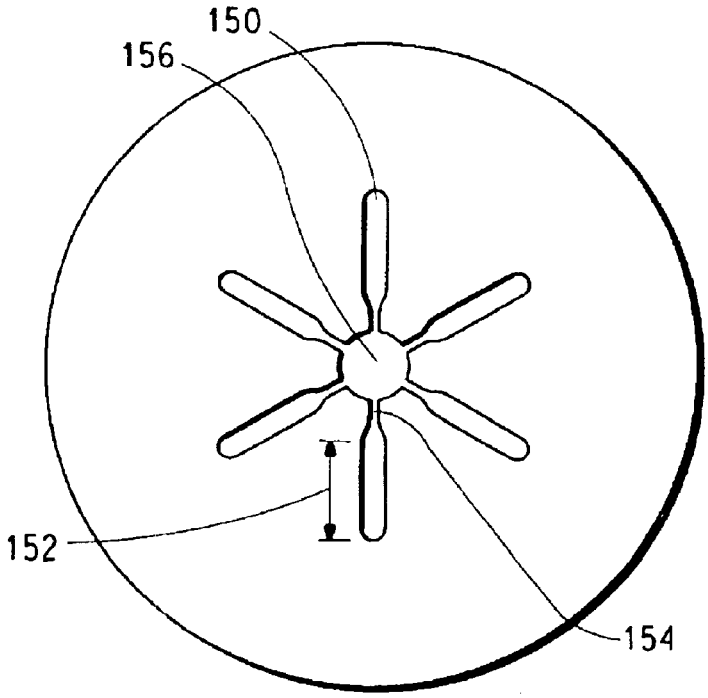
FIG. 6B is a representation of an orificie Plate B in plan view at 90° to the stacked plate spinneret assembly shown in FIG. 6 and taken across lines 6B—6B of FIG. 6.
Figure 6C:
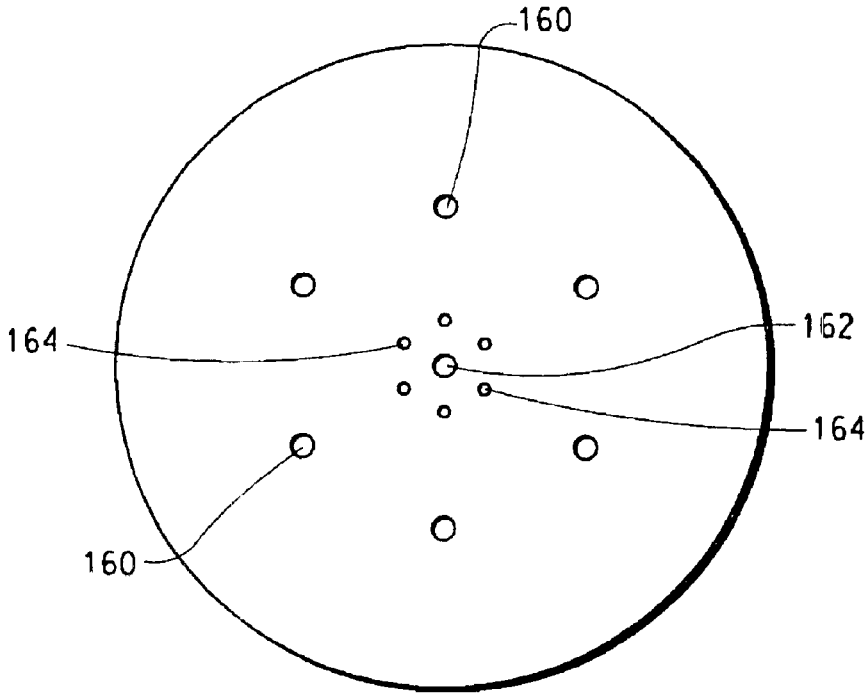
FIG. 6C is a representation of orifice Plate C in plan view at 90° to the stacked plate spinneret assembly shown in FIG. 8 and taken across lines 6C—6C of FIG. 6.
Figure 7A:
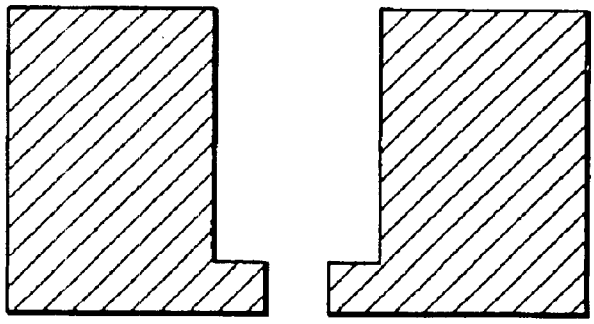
FIG. 7A (PRIOR ART)
FIG. 7A shows in cross-sectional cut-away a representation a prior art spinneret plate.
Figure 7B:
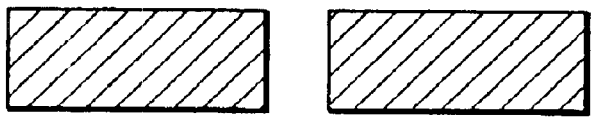
FIGS. 7B and 7C show in cross-sectional cut-away a representation two spinneret plates of the invention.
Figure 7C:
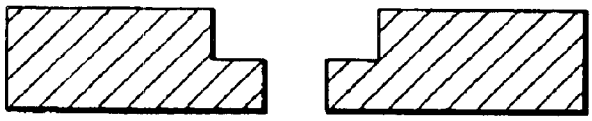
Figure 8:
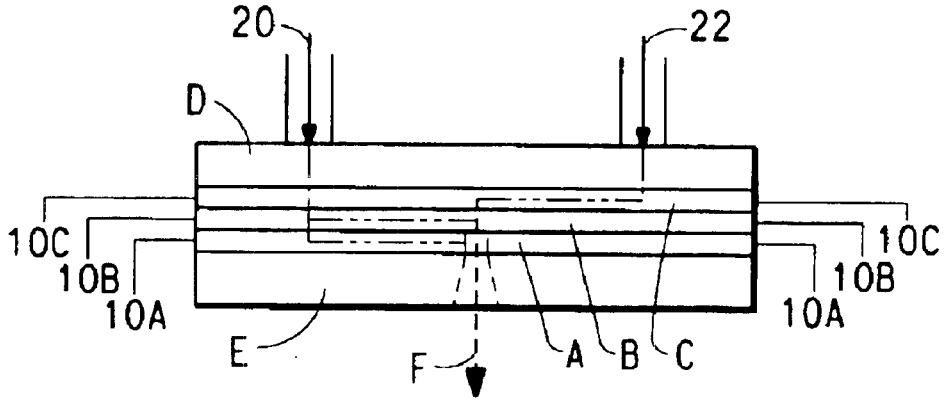
FIG. 8 is a representation of a stacked plate spinneret assembly, in side elevation, that can be used to make alternative embodiment fiber of the invention.

To make filaments having any number of symmetrically placed wing polymer portions, the same number of symmetrically arranged orifices are used in each of the plates. For example in FIG. 6A, spinneret Plate A is shown in a plan view oriented 90° to the stacked plate configuration of FIG. 5. Plate A in FIG. 6A is comprised of six symmetrically arranged wing spinneret orifices 140 connected to a central round spinneret hole 142. Each of the wing orifices 140 can have different widths 144 and 146. Shown in FIG. 6B is the complementary distribution Plate B having distribution orifices 150 tapering at an open end 152 to optional slot 154 connecting the distribution orifices to central round hole 156. Shown in FIG. 6C is metering Plate C with metering capillaries 160 for the wing polymer and a central metering capillary 162 for the core polymer. Polymer melt pool Plate D can be of any conventional design in the art. Spinneret support Plate E has a through hole large enough and flared away (for example at 45–60°) from the path of the newly spun filament so that the filament does not touch the sides of the hole, as is shown in FIGS. 7 and 8 side elevation. The stacked Plate Assembly, Plates A through D, are aligned so that core polymer flows from polymer melt pool Plate D through central metering hole 162 of metering Plate C and through the 6 small capillaries 164, through central circular capillary 156 of distribution Plate B, through central circular capillary 142 of spinneret assembly Plate A, and out through large flared hole in spinneret support Plate E. At the same time, wing polymer flows from polymer melt pool Plate D through wing polymer metering capillaries 160 of metering Plate C, through distribution orifices 150 of distribution Plate B (in which, if optional slot 154 is present, the two polymers first make contact with each other), through wing polymer orifices 140 of spinneret Plate A, and finally out through the hole in spinneret assembly support Plate E.

The spinneret pack of the invention can be used for the melt extrusion of a plurality of synthetic polymers to produce a fiber. In the spinneret pack of the present invention, the polymers can be fed directly into the spinneret capillaries, since the spinneret plate does not have a substantial counterbore. By no substantial counterbore is meant that the length of any counterbore present (including any recess connecting the entrances of a plurality of capillaries) is less than about 60%, and preferably less than about 40%, of the length of the spinneret capillary. See FIG. 7A, which shows a cross-sectional of a spinneret plate of the prior art and FIGS. 7B and C, which shows a cross-section of spinneret plates of the present invention. Directly metering multicomponent polymer streams into specific points at the backside entrance of the fiber forming orifice in the spinneret plate eliminates problems in polymer migration when multiple polymer streams are combined in feed channels substantially before the spinneret orifice, as is the norm.

It can be useful to combine the functions of two plates into one through the use of recessed grooves, on one or both sides of the single plate with appropriate holes through the plate to connect the grooves. For example, recesses, grooves and depressions can be cut in the upstream side of the spinneret plate (for example by electrodischarge machining) and can function as distribution channels or shallow, insubstantial counterbores.

A variety of fibers comprising two or more polymers can be made with the spinneret pack of the present invention. For example, other biconstituent fibers and bicomponent fibers not disclosed and/or claimed herein can be so made, including the cross-sections disclosed in U.S. Pat. Nos. 4,861,660, 3,458,390, and 3,671,379. The resulting fiber cross-section can be for example side-by-side, eccentric sheath-core, concentric sheath-core, wing-and-core, wing-and-sheath-and core, and the like. Moreover, the spinneret pack of the invention can be used to spin splittable or non-splittable fibers.

Figure 8A:
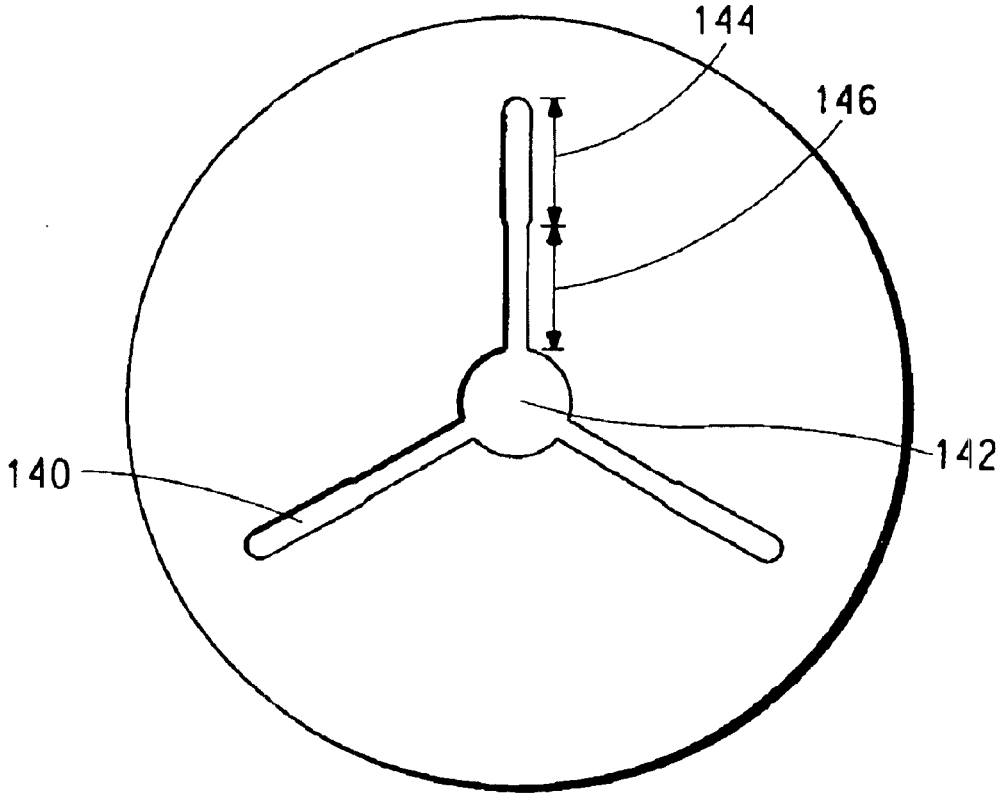
FIGS. 8A, 8B and 8C show respectively, an alternative embodiment of a spinneret plate, distribution plate, and metering plate, in plan view at 90° to the stacked plate spinneret assembly of FIG. 8, each of which can be used in a spinneret pack assembly of the invention to make an alternative embodiment fiber of the invention.
Figure 8B:
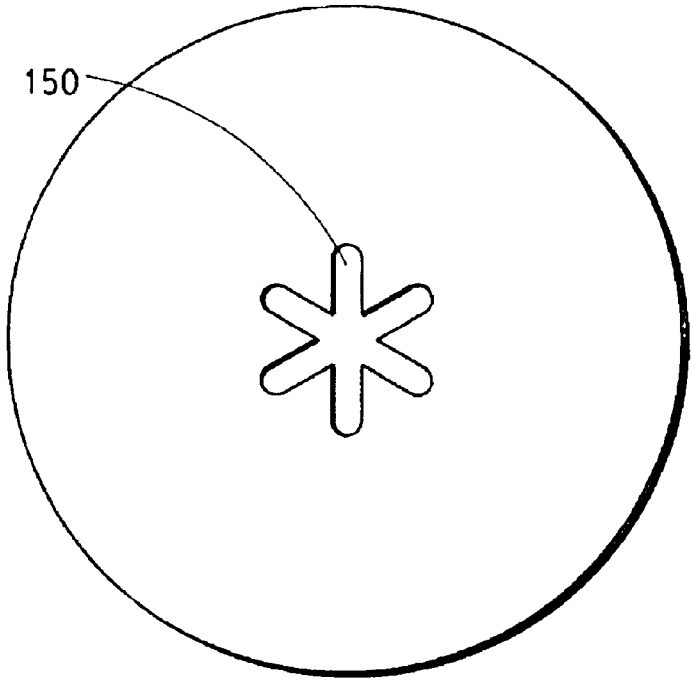
Figure 8C:
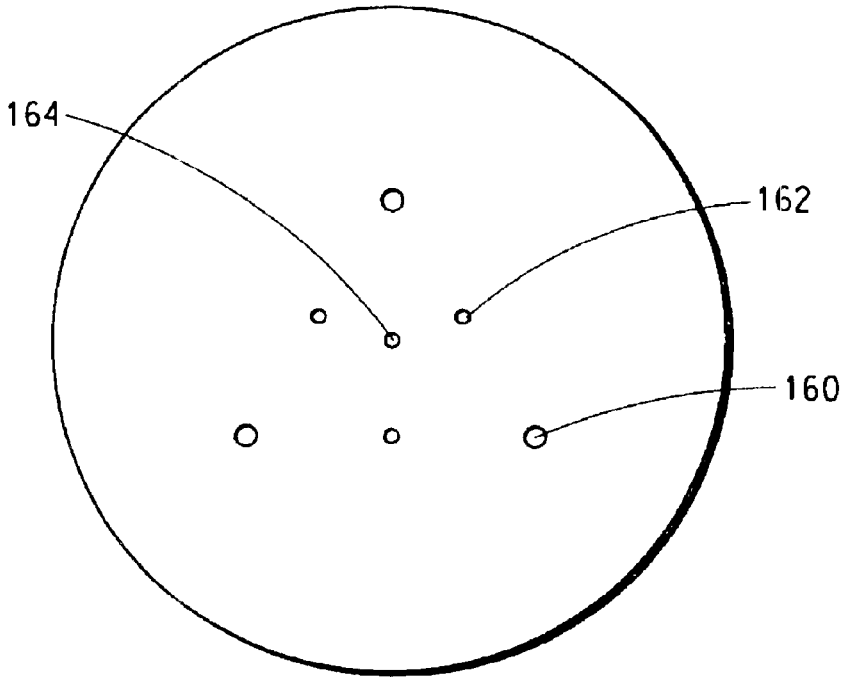

The spinneret pack of the invention can be modified to achieve different multiwinged fibers, for example, by changing the number of capillary legs for a different desired wing count, changing slot dimensions to change the geometric parameters as needed for production of a different denier per filament or yarn count, or as desired for use with various synthetic polymers. For example, in the embodiment of FIG. 8 is shown a relatively thin spinneret pack used to make a fiber with three wings. In FIG. 8A, the spinneret plate was 0.015 inches (0.038 cm) thick and had orifices machined through the full thickness of stainless steel, by the laser light methods herein disclosed, in the form of three straight wings 140 each of two widths (having lengths 144 and 146 respectively) and arranged symmetrically at 120 degrees apart around a center of symmetry; there was no counterbore above the capillary orifice. Each wing 140 was 0.040 inches (0.102 cm) long from its tip to the circumference of a central round spinneret hole 142 of 0.012 inches (0.030 cm) diameter whose center coincided with the center of symmetry. Referring next to FIG. 8B, distribution plate B, of 0.010 inch (0.025 cm) thickness, was coaxially aligned over spinneret plate A so that every other wing orifice 150 of distribution plate B was aligned with a wing 140 of spinneret plate A; each wing orifice 150 of distribution plate B was 0.1375 inches (0.349 cm) long from its tip to the center of symmetry. Metering plate C (FIG. 10C) was 0.010 (0.025 cm) inches thick and had holes 160 of 0.025 inch (0.064 cm) diameter, holes 162 of 0.015 inch (0.038 cm) diameter, and central hole 164 of 0.010 inch (0.025 cm) diameter. Plate C was aligned with distribution plate B so that, in use, wing polymer fed by melt pool plate D (see FIG. 8) to holes 160 and core polymer fed to holes 162 and 164 of distribution plate C were distributed by plate B to plate A to form a fiber, in which the wings penetrated the core. There was no counterbore in spinneret plate A, and the combined thickness of plates A, B, and C was only about 0.035 inches (0.089 cm).

Figure 9A:
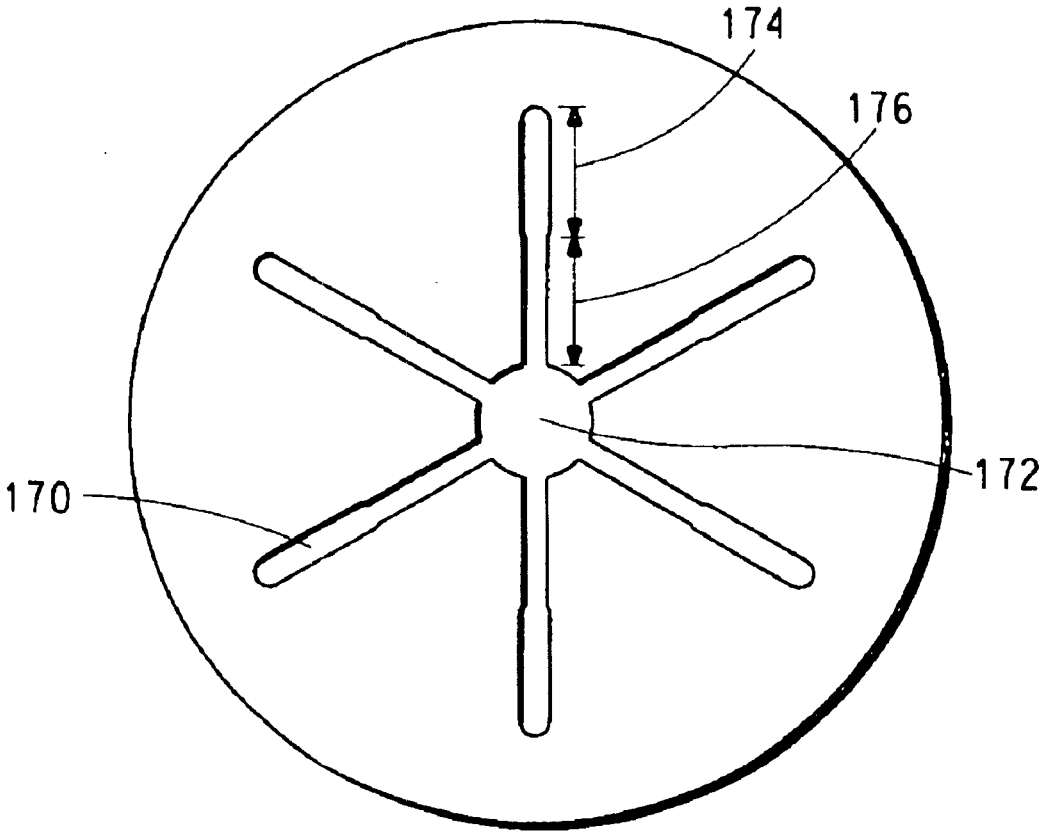
FIGS. 9A, 9B, and 9C show respectively, another alternative embodiment of a spinneret plate, distribution plate, and metering plate, in plan view at 90° to the stacked plate spinneret assembly of FIG. 8, each of which can be used in a spinneret pack assembly of the invention to make an alternative embodiment fiber of the invention.
Figure 9B:
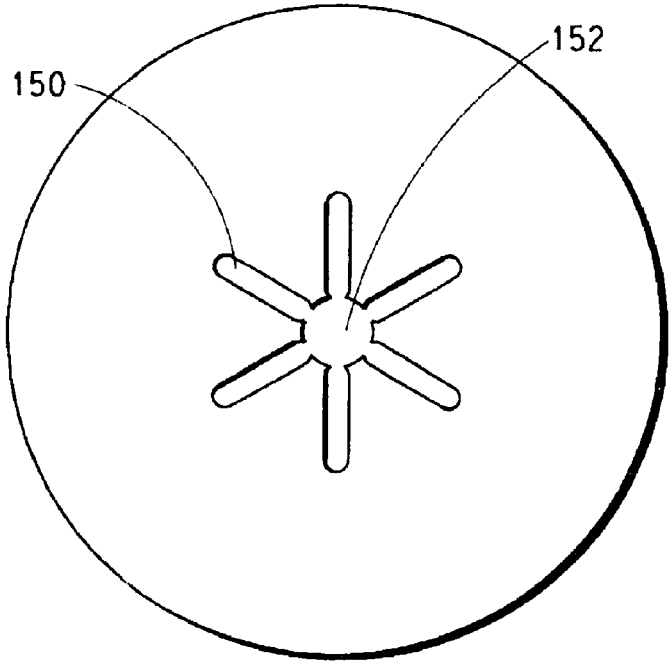
Figure 9C:
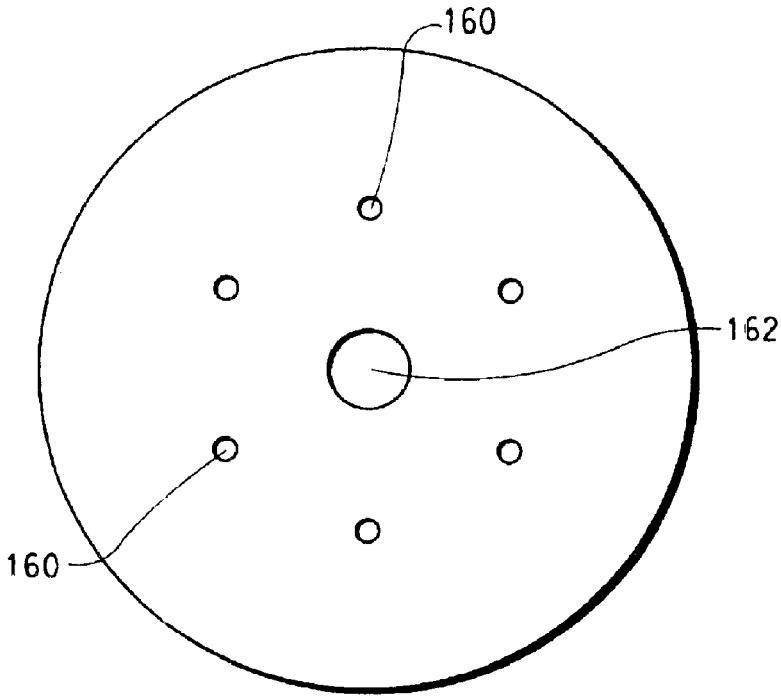

In another spinneret pack assembly embodiment, no spinneret support plate E (see FIG. 8) was used. In FIG. 9A, spinneret plate A was 0.3125 inch (0.794 cm) thick, and each spinning orifice had an 0.100 inch (0.254 cm) diameter counterbore and an 0.015 inch (0.038 cm) long capillary at the bottom of the counterbore. As shown in FIG. 9A, each spinneret orifice in spinneret plate A had six straight wing orifices 170, each of which had a long axis centerline which passed through a center of symmetry and had a length of 0.035 inch (0.089 cm) from its tip to the circumference of central round hole 172. Length 174 from the tip of each wing to 0.015 inch (0.038 cm) was 0.004 inch (0.010 cm) wide; length 176 was 0.020 inch (0.051 cm) long and 0.0028 inch (0.007 cm) wide. The tip of each wing was radius-cut at one-half the width of the tip. Distribution plate B (see FIG. 9B) was 0.015 inch (0.038 cm) thick and had six-wing orifices, each of which was centered above a corresponding counterbore in spinneret plate A and oriented so that each wing orifice in plate B was aligned with a wing orifice of plate A. Each wing orifice 150 in plate B was 0.060 inch (0.152 cm) long and 0.020 inch (0.051 cm) wide, and its tip was rounded to a radius of 0.010 inch (0.025 cm). Central hole 152 in plate B was 0.100 inch (0.254 cm) in diameter. Metering plate C (see FIG. 9C) was also 0.015 inch (0.038 cm) thick. In plate C, holes 160 had a diameter of 0.008 inch (0.020 cm) and were 0.100 inch (0.254 cm) from the center of central hole 162, which of plates B and A and formed the core of the fiber. Non-elastomeric wing polymer was fed to holes 160 in plate C and passed through the wing orifices of plates B and A to form the wings of the fiber. Wing and core polymers first make contact at the top of distribution plate B, which is 0.328 inch (0.833 cm) above the face of spinneret plate A from which the fiber is extruded was 0.080 inch (0.203 cm) in diameter. Plate C was aligned with plate B so that the six holes 160 of plate C were above the centerlines of the wing orifices 150 of plate B. The plates were aligned so that elastomeric core polymer fed to hole 162 of plate C passed through the center.

The hetero-composite yarn of the present invention also comprises a companion yarn, which is shown at 20 in FIG. 1. The hetero-composite yarn comprises a man-made or natural fiber. This companion yarn is any yarn other than the same biconstituent yarn and preferably has lower shrinkage than the biconstituent yarn. The companion yarn can be formed of a man-made, fiber-forming, melt-spinnable polymers including, but not limited to, polyamides, polyolefins, such as polyethylene and polypropylene, polyesters, viscose polymers, such as rayon, and acetate, or combinations thereof. The polyamides, polyesters, polyolefins, and bicomponents used in the companion yarn can be selected from any of such polymers known, including those discussed above with reference to the wings of the biconstituent filaments. The polymers used to make up the companion yarn may have any cross-sectional shape. The cross-sectional shapes, for example, may include round, oval, trilobal shapes with higher numbers of symmetric or unsymmetric lobes, and dog-bone shaped. In addition, the companion yarn may be or include natural fibers, such as cotton, wool, and/or silk. Preferred companion yarns include nylon, polyester, polyolefin, rayon, cotton and wool. Examples of commercially available companion yarns include DuPont nylon TACTEL® products known in the industry as Multisoft, Microdeniers and Diablo. Also, especially useful is any yarn that lends itself to air-entangling, or air-jet texturing or carding (for staple). Additives or treatments, such as discussed above with reference to the biconstituent yarn, can be used with the companion yarn. The choice of the companion yarn is broad; generally its aesthetic impact in fabric guides that decision.

Preferably, the companion yarn is less elastomeric than the polymer of the core. Also, the companion yarn generally has lower shrinkage than the biconstituent filament. The companion yarn may be a single fully drawn or hard yarn, or a bicomponent yarn or another biconstituent yarn. For example, combining a biconstituent of lower shrinkage and percent recoverable stretch (after boil-off stretch), with a biconstituent of higher shrinkage and percent recoverable stretch could be advantageous, for example, to provide yarns of certain composite stretch and recovering properties. If two biconstituent yarns are combined then there would likely not be a self-bulking effect, since neither biconstituent generates bulk upon stretching.

Where the companion yarn is a single component drawn yarn, it has been found that yarns having less than about 80% elongation to break, preferably less than about 60% elongation to break, more preferably less than about 50% elongation to break, measured using standard ASTM intron technique D2256 (or TRL-TM1356) are particularly useful for the present invention.

The combined biconstituent yarn and the companion yarn may be present in the final product in varying ratios depending on the intended use, for example, the weight ratio of the two yarns can range from about 90/10: about 10/90, more preferably 80/20 to 20/80. The fraction of each of the components of the final product may be measured, e.g., according to its total denier and denier per filament. The greater the total denier or denier per filament, the greater the amount of the component in the final product. Modifying the components based upon these factors may achieve different functions of the final product. For example, a higher stretch and recovery power may be obtained by having a greater fraction of the biconstituent yarn in the final product. Conversely, a fabric having less stretch and recovery power may be obtained by having a greater fraction of the second yarn, where the companion yarn is a single component yarn.

As noted above, the biconstituent yarn of the present invention can be a monofilament yarn or formed from a plurality of filaments, for example 2 to 60 filaments. The companion yarn can be formed from, e.g., 2–60 filaments. When the hetero-composite yarn comprises a plurality of biconstituent fibers, the biconstituent fibers can be of different, e.g. decitexes, and the ratios of the elastomeric to non-elastomeric polymers can differ from fiber to fiber.

The denier per filament of the biconstituent fiber is preferably less than 50, more preferably less than 20, most preferably less than 10 and the denier per filament of the composite yarn is preferably less than 10, more preferably less than 5, most preferably less than 2.5, e.g., about 0.5 to about 50 dpf. The dpf of the filaments within the yarn bundle is a key determinant for softness, hand, and other apparel fabric attributes; winged biconstituent yarns often have an apparent dpf, based on tactility and fabric hand, which is less than their real dpf. For instance, a 20 dpf filament fabric may feel as soft at a 5–10 dpf multifilament yarn in fabric form. Nevertheless, it is often useful for the biconstituent dpf to exceed the companion yarn dpf so dramatically if tactility and uniformity are critical.

The total denier of the hetero-composite yarn can range from about 20 to about 300 denier for typical apparel applications. Industrial, upholstery or flooring applications may range from 100 to several thousand denier. Preferred companion yarns are 10–300 total denier for apparel and 300 to 3000 denier for upholstery; more preferably 20–200 total denier; and filament counts consistent with denier per filaments of 0.5–50; more preferably 1.0 to 10 for apparel.

When the hetero-composite yarn of the present invention has low denier, it may be used for making fine fabrics, while a yarn having high denier may be used for heavier fabrics. Accordingly, the yarn of the present invention may have any yarn denier suitable for its final end use product. For fine fabrics, the yarn may have a sum denier of the combination of the biconstituent denier and the companion yarn of less than about 60, preferably less than about 50, and more preferably, less than about 40 to as low as 10 denier. For medium weight fabrics, the hetero-composite yarn may have a denier of between about 50 to about 200, preferably about 70 to about 150, and more preferably about 70 to about 140. For heavier fabrics, such as load-bearing fabrics, the hetero-composite yarn may have a denier of between about 200 to about 2400, preferably about 200 to about 2000.

The hetero-composite yarns of the present invention are preferably self-bulking. This means that they are formed from biconstituent filaments that exhibit high shrinkage on finishing (the biconstituent portion), and the companion filaments which have less shrinkage. The biconstituent filaments generally will show 20–100% recoverable stretch (after boil-off stretch), with preferably greater than 25%, and preferably greater than 50%. Also, the biconstituent filaments will generally show 10–30% non-recoverable shrinkage, preferably less than 30%, and more preferably less than 25%. The lower shrinkage companion yarn filaments will generally show 1–15% non-recoverable shrinkage. When the biconstituent, high shrinkage filaments are activated (shrink), the companion yarn bends and enhances the bulk of the composite yarn. Thus, the yarns shrink in length substantially in textile finishing processes (hot, wet treatments) and gain in volume cubically. The hetero-composite yarn of the present invention shows high stretch recovery, that is, after stretching 20% to 100% of their initial relaxed length after boil-off, they readily recover to near their original relaxed length.

The hetero-composite yarn can be handled like a hard yarn without the need for special tensioning. After finishing, there is provided true elastomeric recovery properties; that is, the surface of the yarn is integral and dyeable in the same manner as the companion hard yarns. The hetero-composite yarn is amenable to larger package size since it is in hard yarn form, and has a non-tacky hard yarn surface.

A wide variety of aesthetics and hand can be obtained from the hetero-composite yarns of the present invention. These effects will depend, e.g., on the nature of the companion yarn (e.g., dpf, filament x-sectional shape, total denier, shrinkage), the particular biconstituent yarn composition, the ratio of the components, and the manner of combining used. The hetero-composite yarns have the property of processing like hard yarns, and generating stretch and elastomer driven recovery through heat or hot/wet processing. If yarns are selected such that the biconstituent wings, and the companion yarns are from a similar polymer families, excellent dye uniformity can be achieved. Alternatively, different polymer families can be employed to generate heathering effects in combination with good stretch and recovery.

The hetero-composite yarns may be used to form fabrics by known methods including by circular, warp, or flat knitting, seamless knitting, hosiery knitting, by weaving as weft yarn, or warp yarn, or both. Yarns may be in the form of continuous filaments or pre-combining in the form of staple yarns.

Figure 10:
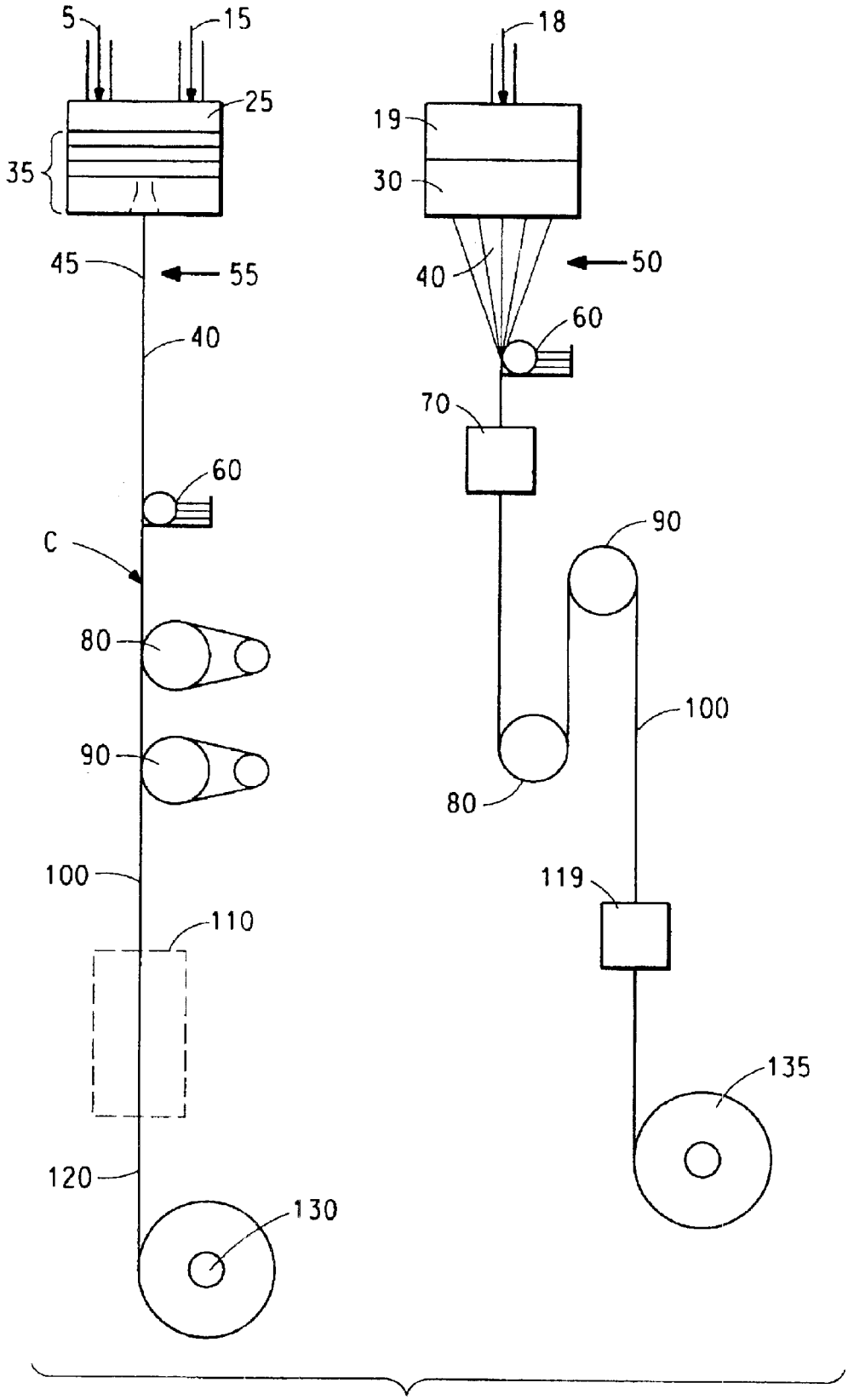
FIG. 10 is a schematic of a process for spinning a biconstituent filament and a process for spinning a companion yarn.

Further in accordance with the present invention, there is provided a process of making a hetero-composite yarn. The process comprises commingling a biconstituent yarn with a companion yarn. The biconstituent yarn comprises at least one filament with an axial core comprising a thermoplastic elastomeric polymer and a plurality of wings attached to the core, the wings comprising a thermoplastic, non-elastomeric polymer. FIG. 10 is a schematic of a process for spinning a biconstituent yarn, spinning a companion yarn and commingling the biconstituent yarn and the companion yarn.

Following FIG. 10, a first hard thermoplastic polymer, from a source not shown, is introduced at 5 and a second elastic thermoplastic polymer, from a source not shown, is introduced at 15. The first and second polymers are combined in a spin pack distribution body 25 and extruded from bicomponent spinneret 35 to form a biconstituent filament, such as a monofilament 45. This biconstituent filament is quenched, i.e., cooled and solidified by a cross flow of air 55 and then oiled with a fiber finish composition at 65 and wound up into a package of monofilament yarn at 95.

On the right side of FIG. 10, a hard thermoplastic polymer from a source not shown, is introduced at 18 and directed through spin pack 20 and extruded through a multicapillary spinneret plate 30 to form a plurality of companion yarns 40 which are cooled and solidified by a cross flow of air 50 and converged into a multifilament yarn at 60 where the yarn is oiled with a fiber finish and forwarded through an entangling device 70, providing good filament cohesion to the yarn bundle, and into a draw zone between feed roll 80 and draw roll 90, the yarn 100 is drawn by factor equal to the ratio of the surface speed of roll 90 versus roll 80, and pulled through yarn entangling device 110 by the winder to form a yarn package 120. Optionally yarn 100 can be undrawn, in which case roll speed 90 is equal to that of 80.

The process of the present invention may comprise an additional step, after quenching, of heat-relaxing the fiber so that it exhibits at least about 20% after boil-off stretch. The heat-relaxing is carried out with a heating medium of dry air, hot water or superatmospheric pressure steam at a temperature in the range of about 80° C. to about 120° C. when the heating medium is said dry air, about 75° C. to about 100° C. when the heating medium is said hot water, and about 101° C. to about 115° C. when the heating medium is said superatmospheric pressure steam.

Figure 11:
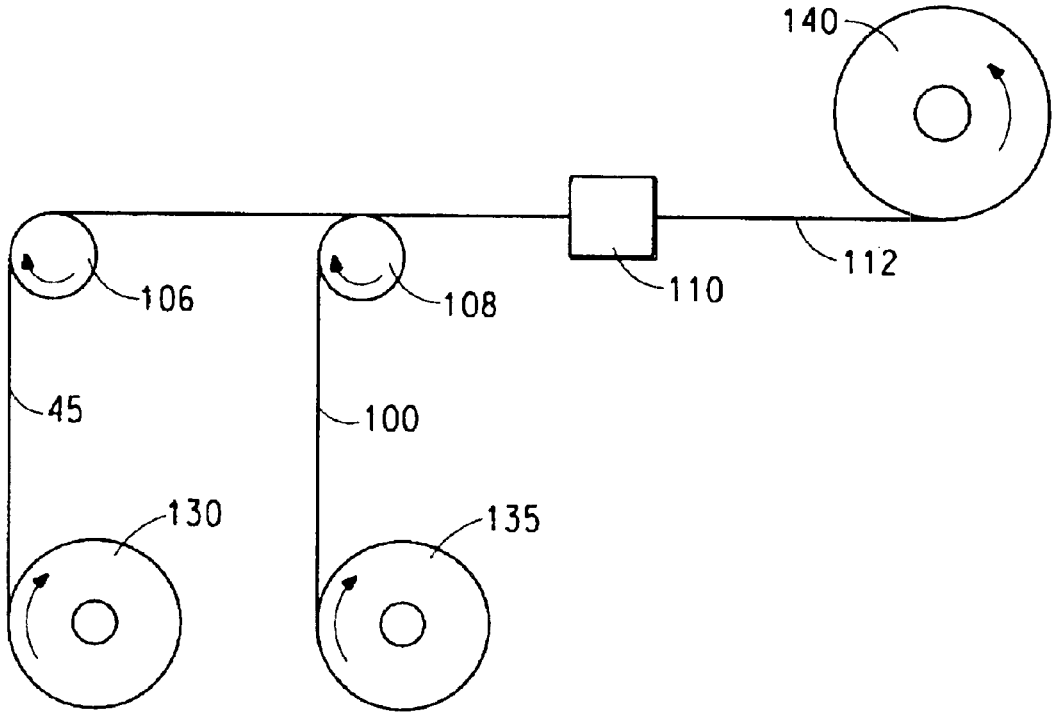
FIG. 11 is a schematic of alternative process schemes for combining a biconstituent filament with a companion yarn.

The biconstituent yarn and the companion yarn can be combined in any form, in either filament or yarn format, or even before the filament format, in or before the spinneret. In FIG. 11 a process is illustrated for combining the biconstituent filament yarn from a yarn package with the companion yarn from a yarn package by use of an entangling device. Taken together, the process of FIG. 11, along path C, and the process of FIG. 10 provide a method for making the hetero-composite yarn of the invention in a two-stage (split) process. In FIG. 11 the biconstituent yarn 45 from package 95 and the hard yarn 100 from package 120 are combined using change of direction rolls 106 and 108 to forward yarns 45 and 100 through an air jet entangling device 110 to form a hetero-composite yarn 112 wound on package 130.

Figure 12:
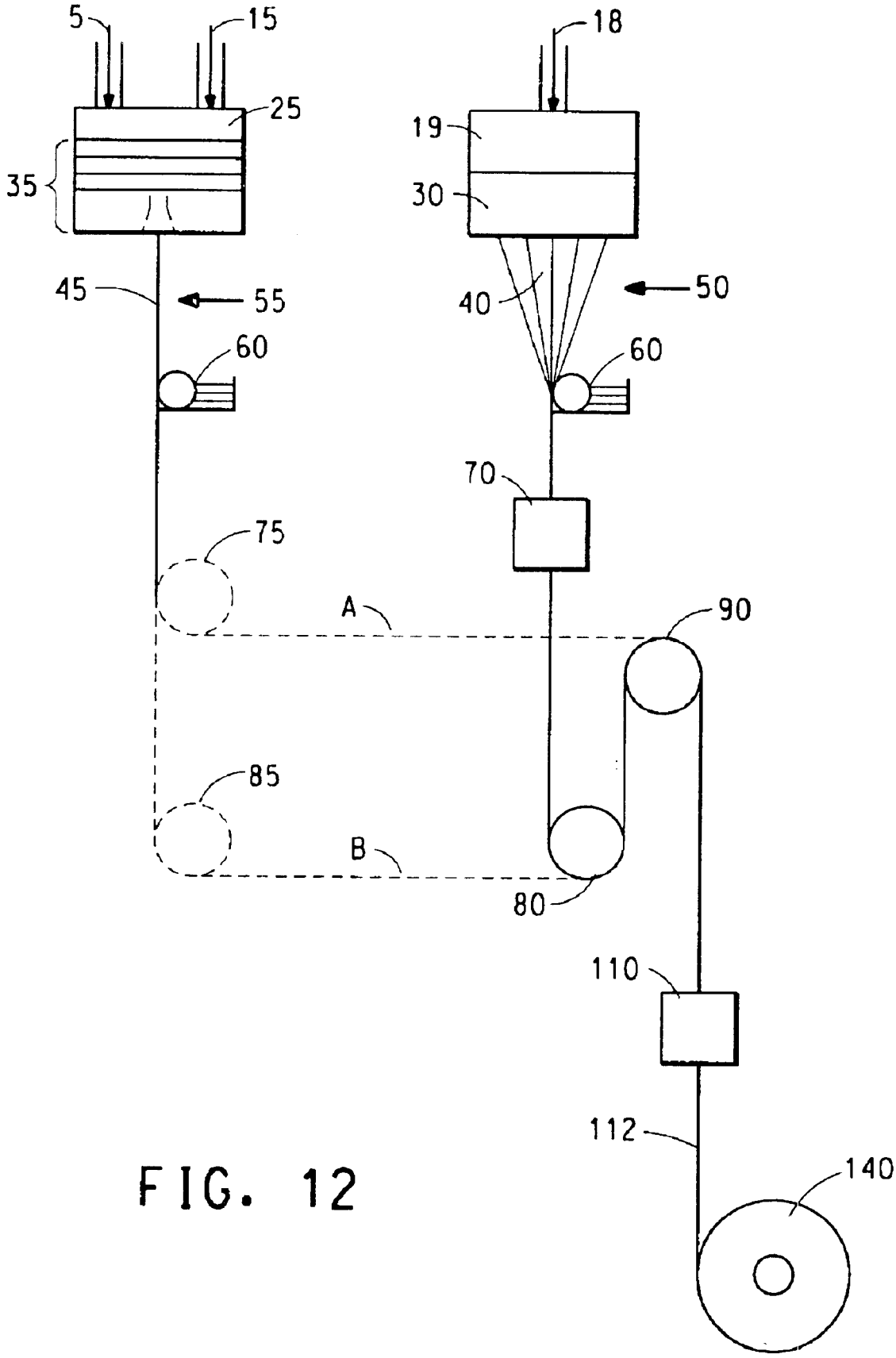
FIG. 12 is a schematic of an alternative process for combining a biconstituent filament with a companion yarn.

In FIG. 12 a process scheme for spinning the biconstituent filament along path A and B is depicted along with a process for spinning the companion yarn, in a two-stage (split) process. The elements in FIG. 12 which are common to FIG. 10 are the same as those described above with respect to FIG. 10. In this process variation, the biconstituent yarn in its hard yarn configuration is spun separately and spooled from a production package 75 or 85 directly into the spinning process of the companion yarn following either path A or path B. In the companion yarn process, the biconstituent is entangled with the companion yarn by an intermingling jet (not shown) of the companion yarn process. The hetero-composite yarn so formed is wound onto a single yarn package 130.

As discussed above, the invention combines the biconstituent yarn with the companion yarn to form a single yarn. Each of the biconstituent yarn and combined yarn may be made separately off-line and then combined to form the final synthetic yarn, or one or both may be made on-line in a continuous manner. Combining these components to form a single yarn may be conducted by any known method, including plying, co-spinning, air jet texturing, air false twist texturing, and covering. Plying is simple combining by laying yarns together without mixing of filaments. Plying may be conducted by twisting the yarns together in a draw twister. Typically, the yarns may be twisted at about 0–5 turns-per-inch (tpi), and preferably, ¼–½ tpi. Co-spinning is combining by laying yarns together in the spinning process; up to, for example, 4000 meters per minute. Co-spinning may be conducted by commingling yarns in an interlaced jet. Air entangling is a process that causes filaments of the biconstituent and second yarn to become intermingled; typically processing speed is 500 to 1000 meters per minute. Air jet texturing is a process where two yarn are fed to an air jet texturing apparatus; typically one yarn is over-fed (effect yarn) with respect to the other (core yarn). The effect yarn is crimped and bulked and entangled with the core yarn. 100 to 400 meters per minute is a typical speed. Air jet texturing may be conducted by overfeeding the biconstituent yarn and the companion yarn through an air jet texturing machine at different speeds to create a bulkier yarn entangled at nodes along the end. Core spinning is a process where a staple yarn is spun and wrapped around a core yarn to cover the core yarn. Mechanical covering is a process where a continuous yarn is mechanical wrapped around a core yarn. If the yarns are combined by covering, either the biconstituent yarn or the companion yarn may be used to wrap the other yarn. However, to maximize stretch potential, it is preferable to use the biconstituent as the core yarn. Combining can also be accomplished by the serial process of false twist texturing a hard yarn followed by co-entangling with the biconstituent yarn prior to package winding.

There also can be used co-stretch breaking technology as disclosed in WO77283, or there can be used as methods for combining the yarn with variations in entangling or twisting a long the end that creating "fancy" bulked yarn effects. Staple blends can be created using specialized equipment similar to that used in the worsted yarn industry for "stretch-breaking" continuous filament yarns. Biconstituent and companion yarns in continuous form can be feed into a series of nip rollers running at sufficiently different speeds, with sufficient nip force, that the individual filaments within the yarn bundle are pulled to the breaking point creating a staple yarn, while the continuity of the overall yarn bundle in maintained, in a continuous operation. Such yarns can be blended on worsted combing machines to create a hetero-composite-staple composite yarn which can be drawn and twisted into a finer yarn.

In the process of the present invention as described above, the biconstituent yarn and the companion yarn are either fully drawn or partially drawn during processing. The intermingling of the biconstituent and companion yarn can be accomplished by, e.g.,:

(a) intermingling of two partially oriented yarn (POY) followed by drawing, (b) intermingling of two drawn yarns, or (c) some combination of these.

In one method, a biconstituent yarn in its hard yarn as-spun configuration is combined with the companion yarn. Both yarns are spun separately and intermingled with entangling jets in a separate step. The hetero-composite yarn so formed is wound onto a single yarn package. Typical intermingling speed can range from about 600 to about 800 meter per minute.

In a second method, the biconstituent yarn in its hard yarn configuration is spun separately and spooled from a production package directly into the spinning process of the companion yarn. The biconstituent yarn is entangled with the companion yarn by the intermingling jet of the second yarn process. The hetero-composite yarn so formed is wound onto a single yarn package. Typical wind up speed can be about 1500 to about 4000 meters per minute.

In a third method, an integrated single-stage process is used. The threadlines of the biconstituent and the companion yarn are brought together and intermingled before winding up a hetero-composite yarn. Intermingling speed can range from about 600 to about 800 meters per minute.

In a fourth method a two-stage or optionally, an integrated single-stage process is used. Here the biconstituent yarn and the companion yarn are partially drawn (e.g., both yarns are partially oriented yarns (POY)) during their production and both yarns combined and entangled by use of the intermingling jet of the companion yarn process. Intermingling speed could be accomplished by e.g., second spinning speeds at a feed roll of about 600 to about 1000 meter per minute and wound up after drawing at wind up speeds of about 2000 to about 4000 meters per minute.

In a fifth method, the biconstituent yarn is partially drawn (e.g. a POY) and the second yarn is fully drawn during production and both yarns combined and entangled by an intermingling jet of the companion yarn process.

In a sixth method, the biconstituent yarn is fully drawn in production and the companion yarn is partially drawn (e.g., a POY) during production. Both yarns are combined and entangled by an intermingling jet of the companion yarn process.

Combining can also include covering by wrapping one yarn around the other yarn. If the yarns are combined by covering, either the biconstituent yarn or the companion yarn may be used to wrap the other yarn.

The hetero-composite yarn process eliminates the elastomeric yarn covering process and the false twist texturing processes used for conventional fabric production. The process of the invention provides an integrated melt spun yarn and selection of aesthetics, combined with a selection of bulk and stretch and recovery properties.

The invention is illustrated by the following non-limiting examples.

Test Methods

Stretch properties (after boil-off stretch, after boil-off shrinkage and stretch recovery after boil-off) of the fibers prepared in the Examples below were determined as follows. A 5000 denier (5550 dtex) skein was wound on a 54 inch (137 cm) reel. Both sides of the looped skein were included in the total denier. Initial skein lengths with a 2 gram weight (length CB) and with a 1000 gram weight (0.2 g/denier) (length LB) were measured. The skein was subjected to 30 minutes in 95° C. water ("boil off"), and initial (after boil off) lengths with a 2 gram weight (length $CA_{initial}$) and with a 1000 gram weight (length $LA_{initial}$) were measured. After measurement with the 1000 gram weight, additional lengths were measured with a 2 gram weight after 30 seconds (length $CA_{30\ sec}$) and after 2 hours (length $CA_{2\ hrs}$). Shrinkage after boil-off was calculated as 100×(LB−LA)/LB. Percent after boil-off stretch was calculated as 100×(LA−CA@30 sec)/CA@30 sec. Recovery after boil-off was calculated as $100\times(LA-CA_{2\ hrs})/(LA-CA_{initial})$.

EXAMPLES

Example 1

Air Entangled Biconstituent Composite Yarns in Knit Fabric

An air entangled hetero-composite-yarn with latent stretch and recovery properties was created by air entangling a first a mono-filament biconstituent yarn of the present invention with a second commercially available companion yarn.

Biconstituent Yarn Spinning

The biconstituent yarn was spun as a 19 denier (21 dtex) per filament produced as in Path C of FIG. 1. Other fiber and spinning characteristics were as follows:

| | |
|---|---|
| Denier | 19 |
| # filaments | 1 |
| Wing/core interpenetration | yes |
| Feed Roll Speed (m/min) | 420 |
| Primary Finish | none |
| Primary Finish % | 0 |
| Secondary Finish type | K-9349 |
| Secondary Finish % | 4% |
| Wing Polymer | Camacari N6<br>DuPont Brazilia SA |
| Additive in wing polymer | 5% Nylon 12 Rilson AMNA<br>Atofina |
| Wing Volume % | 40 |
| No. Wings | 5 |
| Core Polymer | Pebax 3533SN from Atofina<br>elastomeric segmented polyetheresteramide<br>flex modulus 2800 psi (19,300 Pascals)<br>Atofina address: |
| Core Volume % | 60 |
| Draw Ratio | 4x (based on drow roll speed) |
| % Face Plate Relaxation | 20% (based on winder speed) |
| Relaxation jet steam pressure system | 3 psi |
| % after boil-off stretch | 95 |
| % absolute shrinkage after BO | 21 |
| % recovery after BO | 90 |

Raw Materials Sourcing

The second yarn was a crimp free nylon 66 multi-filament yarn of 40 denier (44 dtex) and 34 filaments spun and wound-up as yarn package as commercially prepared by E. I. DuPont de Nemours and Co. Nylon Apparel Division. (see 120 in FIG. 1.)

Hetero-composite—Composite Yarn Preparation

The monofilament biconstituent yarn was air mingled with the 40–34 nylon companion yarn using a Hema-jet (Heberlein Type 311 available from Frank and Thomas, Greenvilee, S.C.) air entangling jet (110) shown in FIG. 2. Care was taken to feed the biconstituent monofilament yarn to the entangling jet as a flat hard yarn at low even tension such that no spirally of the wings around the core of the biconstituent filaments occurred during the air entangling process. An entangling speed of 100 yards/minute (91 meters/minute) was used and the resutling composite yarn was wound-up as package 130 in FIG. 2. The entangled yarn had a denier of 59, with the biconstituent filament composing 32% weight of the final yarn. The elastomer content (biconstituent core) represented 19% of the weight of the final entangled yarn. After entangling the composite yarn was wound onto a tube core. The composite yarn showed essentually hard characteristics at this stage of processing, with no unusual stretch or recovery properties.

Fabric Sample

A circular knit single feed length of jersey stitch tubing fabric was fabricated using a Lawson circular tube knitting machine. Tubes were knit in three different stitch densities to check the degree of stretch and recovery imparted in the finished fabric from the above yarn before and after dyeing and finishing. The jersey knit tubes were dyed with standard nylon dyes at the boil (100° C.) for 30 minutes, and dried in a tray oven at 95° C.

Fabric Sample Testing

The stretch and recovery properties of the circular knit fabrics from the entangled yarns were evaluated and the results are shown in Table 1 according to the following definitions:

Layout Length* Greige (LLG) and Layout Width* Greige (LWG) are the measured length and width of a fabric tube section laid flat on a table in the unstress state.

Relaxed Length* Finished RLF) is similarly a measure of the length and width of the finished fabric tube section laid flat on a table in the unstress state.

Stretched Length* Greige (SLG) is measured by folding the fabric in half width-wise, and then stretching the greige fabric to the jamming point by hand against a rule and noting the length.

Stretched Length* Finished (SLF) is similarly measured by folding the fabric in half width-wise, and then stretching the finished fabric to the jamming point by hand against a rule and noting the length.

Relaxed Length* 2nd Cycle (RLF2) is the relaxed length recovered after one stretch cycle.

% Length*Shrinkage is=100*(SLG−SLF)/SLG

% Fabric Stretch=100*(SLF−RLF)/RLF

% Elastic Recovery=100*(SLF−RLF2)/(SLF−RLF)

% Set=100*(RLF2−RLF)/(SLF−RLF)

TABLE 1*

| | | | |
|---|---|---|---|
| Lawson Knitter Needle pull setting | 7.5 | 15 | 20 |
| Layout Length* Greige | 12 | 12 | 12 |
| Layout Width* Greige | 3 | 3 | 3 |
| Stretched Length* Greige | 21 | 17 | 16.5 |
| Stretched Length* Finished | 18 | 14 | 13 |
| % Length* Shrinkage | 14 | 18 | 21 |
| Relaxed Length* Finished | 8.25 | 7 | 7.5 |
| % Fabric Stretch | 118 | 100 | 73 |
| Relaxed Length* 2nd Cycle | 9.5 | 8 | 8 |
| % Elastic Recovery | 87 | 86 | 91 |
| Fabric % Set | 13 | 14 | 9 |

*all lengths and widths are in inches (1 inch = 2.54 cm)

Interpretation

The data indicate that knit fabrics with high percent stretch and excellent elastic recovery properties can be prepared by entangling a moderate percentage by weight (32% in the example) of biconstituent filaments in composite with typical hard (low stretch) multifilament yarns. High percent stretch (73–118% depending on stitch density) and elastomeric recovery (85–93%) properties were generated since the biconstituent filaments shrinks dramatically, but retain much of their shrinkage as recoverable stretch (after boil-off stretch). The biconstituent yarn component of the composite yarn shows sufficient shrink force, that, even at moderate biconstituent content, the companion yarns are crimped or bulked in such a manner that good stretch and recovery properties are retained in the finished fabric. The finished fabric shows a uniform appearance and soft hand with a fabric bulk increased over the greige fabric. The ability to create fabrics with good stretchability and true elastic recovery, using flat, non-stretchable, input yarns is seen as a unique method for creating stretch/recovery fabrics.

Example 2

Air Textured Biconstituent Composite Yarn in Knit Application

Hetero-composite-yarn combinations according to the invention were prepared by combining a feed yarn composed entirely (2.a.) or partially (2.b.) of biconstituent fibers, and an effect yarn containing no biconstituent fibers in an air texturing process.

Raw Materials Sourcing

The polymer raw materials were the same as shown in Example 1. In example 2.a. the feed yarn consisted of 70 denier 10 filaments biconstituent yarn spun as shown below.

In example 2.b. the feed yarn consisted of a combination of at 30 denier monofilament biconstituent feed simultaneous with a 70 denier 66 filament nylon Tactel* commercial yarn sold by E. I. DuPont de Nemours and Co., Wilmington, Del. Properties of the 30 denier biconstituent monofil are shown below.

The effect yarn used in both example 2.a and 2.b. was also 70 denier 66 filament DuPont Tactel*.

Biconstituent Yarn Spinning

| | | |
|---|---|---|
| Denier | 70 | 30 |
| # filaments | 10 | 1 |
| Wing/core interpentration | yes | yes |
| Feed Roll Speed (m/min) | 420 | 420 |
| Primary Finish | none | none |
| Primary Finish % | 0 | 0 |
| Secondary Finish type | K-9349 | K-9349 |
| Secondary Finish % | 4% | 4% |
| Wing Polymer | Camacari N6 | Camacari N6 |
| Wing Volume % | 40 | 40 |
| No. Wings | 5 | 5 |
| Core Polymer | Pebax 3533SN | Pebax 3533SN |
| Core Volume % | 60 | 60 |
| Draw Ratio | 4 | 4 |
| % Face Plate Relaxation | 20 | 20 |
| Relaxation jet steam pressure system | 3 psi | 3 psi |
| % after boil-off stretch | 95 | 96.6 |
| % absolute shrinkage after BO | 21 | 20.5 |
| % recovery after BO | 90 | 92.8 |

Hetero-composite—Yarn Preparation

To achieve an air texturing the effect yarn was forwarded faster, i.e., slightly overfed to the texturing apparatus versus the feed yarn. The air texturing jet was a Hema-jet (Heberlein Type 311 available from Frank and Thomas, Greenvilee, S.C.) air jet (110) shown in FIG. 2. An air jet textured composite yarn was created using a core yarn feed rate of 338 meters/minute, an effect yarn feed rate of 391 meters/minute, an air pressure of 125 psi, and a wind up speed of 312 meters/minute. Two different composite yarns were processed as summarized in Table 2.

TABLE 2

| | Feed Yarn | Effect Yarn |
|---|---|---|
| Composite Yarn 2a. consisted of a multifil biconstituent feed yarn and a multifil homopolymer effect yarn | 70 den. (77 dtex)-10 fil. Lot 67080 7207-44A | 70 den. (77 dtex)-66 fil. |
| Composite Yarn 2b. jconsisted of a biconstituent monofil and homopolymer multifil are feed together as feed yarns; the effect yarn was a multifil homopolymer nylon yarn | 30-1 & 70 den. (77 dtex)-66 fil. (hetero-composite-yarn) | 70 den. (77 dtex)-66 fil. |

Fabric Sample

A single feed Lawson circular knitting machine was used to fabricate knit fabric tubes in a jersey stitch configuration at three stitch densities. The circular knit tubing was acid dyed with nylon dyes at the boil for 30 minutes.

Fabric Sample Testing

The shrinkage, stretch, and recovery properties of the circular knit fabrics from the co-textured yarns were evaluated before and after finishing and the results are shown in Table 3.

TABLE 3

| Lawson Stitch Dial# | MD Length Griege | MD Length after BO | XD width Greige | XD width after BO | MD hand % stretch Griege | MD hand % after boil-off stretch | XD Hand % stretch Griege | XD Hand % stretch after boil-off |
|---|---|---|---|---|---|---|---|---|
| Yarn 2a. | | | | | | | | |
| 7.5 | 10 | 5.75 | 3.25 | 2.62 | 40% | 80% | 125% | 125% |
| 12 | 10 | 5.12 | 3.5 | 2.75 | 30% | 90% | 178% | 115% |
| 20 | 10 | 4.5 | 4.0 | 3.0 | 35% | 120% | 200% | 150% |
| Lawson Stitch Dial# | MD Length Griege | MD Length after BO | XD width Greige | XD width after BO | MD hand stretch Griege | MD hand stretch after boil-off | XD Hand stretch Griege | XD Hand after boil-off |
| Yarn 2b. | | | | | | | | |
| 20 | 26.25 | 15.87 | 4.5 | 3.62 | 40% | 90% | 160% | 125% |

MD* = "LAWSON tube knitting "MACHINE DIRECTION"
XD* = "LAWSON tube knitting "CROSS MACHINE (perpendicular) DIRECTION"

Interpretation

The data indicate that knit elastic fabrics with high stretch and excellent elastic recovery properties can be be generated by co air texturing a moderatge weight percentage of biconstituent filaments in composite with typical hard (low stretch) multifilament yarns. High percent stretch (see table) and elastomeric recovery properties are generated in view of the fact that the initial texturing of the yarn was accomplished in the hard yarn state. The biconstituent yarn component of the composite yarn shows sufficient shrink force, that, even at moderate biconstituent content, the companion yarns are bulked in such a manner that good stretch and recovery properties are retained in the finished fabric. The finished fabric was noted to show a uniform appearance and a soft cotton-like hand with a fabric bulk increased over the greige fabric. The ability to create fabrics with good stretchability and true elastic recovery, using flat, non-stretchable, input yarns is seen as a unique method for creating stretch/recovery fabrics.

Example 3

Air Jet Textured Biconstituent Composite Yarn in Woven Application

Raw Materials Sourcing

The raw materials and supply yarns were those used as in example 2.a.

| Feed Yarn | Effect Yarn |
|---|---|
| A. 70-10 Biconstituent | 70–66 nylon |

Biconstituent Yarn Spinning

The biconstituent yarn was spun at the following conditions:

| | |
|---|---|
| Denier | 70 |
| # filaments | 10 |
| Wing/core interpentration | none |
| Feed Roll Speed (m/min) | 420 |
| Primary Finish | none |
| Primary Finish % | 0 |
| Secondary Finish type | K-9349 |
| Secondary Finish % | 4% |
| Wing Polymer | Camacari N6 |
| Wing Volume % | 40 |
| No. Wings | 5 |
| Core Polymer | Pebax 3533SN |
| Core Volume % | 60 |
| Draw Ratio | 4 |
| % Face Plate Relaxation | 20 |
| Relaxation jet steam pressure system | 3 psi |
| % stretch after boil-off | 100 |
| % absolute shrinkage after BO | 20 |
| % recovery after BO | 90 |

Hetero-composite—Yarn Preparation

A hetero-composite-air-textured yarn was created by combining two yarns, as feed and effect yarns, in an air jet texturing process as in Example 2A.

Fabric Sample

A fabric was woven on a shuttle loom using a plain weave construction from the composite yarn of the example. The woven fabric construction was based on a 200 denier 34 filament Tactel* nylon (yarn available form E. I. DuPont de Nemours and Company) as the warp fiber with 60 ends per inch. The co-air jet texture composite yarn was used as the weft or fill fiber. The greige fabric width was 62.5 inches. The fabric was finished with a relaxed scour at 160 F, a second relaxed scour at 180 F, and dyed at the boil using standard acid dyes, then air dried without heat setting. The width of the fabric after relaxing, dyeing, and air drying was 50 inches.

Fabric Sample Testinq

The fabric were observed to be non-bulky, smooth, and wrinkle-free with only air drying, and showed good stretch and recovery, and excellent hard fiber hand and aesthetics. The relaxed finished fabric showed the following characteristics:

Basis weight: 3.5 oz/sq yd or 119 gr/$m^2$

Thickness: 10.4 mils (0.0104 inches) (0.026 centimeters)

Fill Count: 70

Warp Count: 85

A 5 cm width×10 cm length of fabric was evaluated for % stretch and recovery in the weft. Using the method of Example 1. the fabric stretched 28% in the weft direction, and showed recovering after stretching of >85%.

Interpretation

The data indicated that the biconstituent composite yarns of the invention are suitable for fabricating weft woven fabrics with useful stretch and recovery properties.

Example 4

Biconstituent Composite Staple Yarn

Biconstituent Yarn Spinning

A biconstituent fibers with the following properties was spun:

| | |
|---|---|
| Denier | 30 |
| # filaments | 1 |
| Wing/core interpentration | none |
| Feed Roll Speed (m/min) | 420 |
| Primary Finish | none |
| Primary Finish % | 0 |
| Secondary Finish type | K-9349 |
| Secondary Finish % | 4% |
| Wing Polymer | Camacari N6 |
| Wing Volume % | 40 |
| No. Wings | 5 |
| Core Polymer | Pebax 3533SN |
| Core Volume % | 60 |
| Draw Ratio | 4 |
| % Face Plate Relaxation | 20 |
| Relaxation jet steam pressure system | 3 psi |
| % stretch after BO | 96.6 |
| % absolute shrinkage after BO | 20.5 |
| % recovery after BO | 92.8 |

Hetero-composite—Yarn Preparation

In order to demonstrate the potential of latent stretch yarns in staple processing the follow experiment was conducted: Two lots of staple fiber, a) a companion staple fiber consisting of 3 dpf 1.5 inch cut length nylon crimped staple yarn used in commercial staple processing and available from E. I. DuPont de Nemours and Company, and b) the 30 denier monofilament biconstituent fiber described above cut to 4 inch length staple, were first hand carded separately to partially align the staple. The two staples were then hand blended in 50/50 weight proportion, and further hand carded to create a hand spinnable card sliver. The sliver mix was than hand twisted to form a yarn. Further, two length of the yarn were hand plied to form a two-ply yarn of 15,100 denier.

Yarn Sample Testing

To test the latent stretch potential of the staple yarn, untreated and boiled-off samples of the yarn were compared for stretch properties:

| | Denier | % Stretch | % Recovery from Stretch |
|---|---|---|---|
| Untreated Yarn | 15100 | 12% | 95% |
| Boiled Sample | 22700 | 51% | 99% |

Interpretation

The data indicate that biconstituent cut staple fibers can be blended with typical commercial staple fiber to form composite staple yarns which show greatly enhanced stretch and recovery properties after hot wet finishing. The blending is accomplished with the biconstituent in the flat or unactiviated state. The biconstituent staple filaments show sufficient shrinkage force that companion staple filaments can be bulked or bent as the biconstituent filaments shrink, resulting excellent elastic recovery in the final staple yarn after hot wet processing.

Example 5

Biconstituent Composite Staple Yarn, Woven, and Knit Fabric

Biconstituent Yarn Spinning

A biconstituent yarn spun according to the process of Example 1:

| | |
|---|---|
| Wing polymer | N6 3.14 IV Camacari |
| Core polymer | Pebax* 3533SN supplied by Atofina |
| Wing/Core ratio | 40/60 |
| No. of wings/filament | 5 |
| Denier total as spun | 20 |
| Number of filaments | 1 |
| Geometry | keylock |
| Draw Ratio | 3.5x |
| Feed Roll Speed | 500 ypm feed roll |
| Relaxation System | none |
| % Relaxation | 0% |
| Finish Type | K-9349 |
| FOY | 4% |

Tensile properties of the yarn were are follows:

| | |
|---|---|
| Tenacity | 2.4 gpd |
| Elongation to break | 28.8% |
| Modulus | 8.1 gpd |

Skein tests revealed the following properties.

| | |
|---|---|
| % stretch after boil off | 99% |
| % retention after boil off | 91% |
| % shrinkage after boil off | 25% |

Hetero-composite—Yarn Preparation

Cutting

Continuous spun yarn was cut to either 3.0 inch or 1.5 inch staple using standard cutting techniques. No heat was applied to the yarn during the cutting process.

Pre-shrinking of Biconstituent Staple

In many cases it is advantageous to process the staple in the as-spun (hard fiber) state, and then activate the shrinkage during post-processing, such as a fabric boil-off, autoclave, or fabric dyeing and finishing step.

In other cases it is advantageous to "pre-shrink" the biconstituent staple prior to further carding, blending, or processing steps. Various methods of pre-shrinking the biconstituent were demonstrated:

Pre-shrink Method #1: 3 pounds of biconstituent 3 inch cut length and 1.5 inch cut length staple was placed in a cloth bags separately, and subsequently the bagged fiber was placed on an autoclave and subjected to 240 F pressurized steam for 20 minutes. The bagged fiber was then placed in a tumble dryer at 100 C for 30 minutes. After processing the fiber was observed to have shrunk to close to half its original length, from either 3.0 inches to 1.5 inches, or from 1.5 inches to 0.75 inches in length. The fiber was observed to have recoverable stretch (after boil-off stretch) of about 95 to 105%. To test opening and processing of the autoclave prepared staple fiber, some of the staple was further run though a Spinlab RotorRing Model #580 at settings: Feed: 7 rpm; Opener: 3800 rpm; Both 3" and 1½" opened easily with no observable damage seen under a microscope.

Pre-shrink Method #2: 3 pounds of biconstituent 3 inch cut length and 1.5 inch cut length staple were placed in cloth bags separately, and subsequently the bagged fiber was placed in a Cook washer. Steam was used to bring the temperature of the water to 200 F, and the bags were agitated for 10 minutes. The wet bags of fiber were then dewatered in an extractor, and placed in a tumble dryer at 170 F for 5 minutes. On opening the bags the fiber was found to open easily and suitable for further staple fiber blending processes. After processing the fiber was observed to have shrunk to close to half its original length, from either 3.0 inches to about 1.5 inches, or from 1.5 inches to about 0.75 inches in length.

Carding, Slivering, and Cotton Spinning 3 pounds of 20 denier biconstituent fiber (as-spun in the pre-activated state) was cut into staple. The fibers were blended with cotton at Hamby Textile Industries such that the final blend was 25% biconstituent and 75% cotton staple, and then carded, drawn, roved, and ring spun at normal twist levels on commercial equipment in the normal manner. An intimately blended 25/75 biconstituent/cofton ring spun yarn was produced with a 8/1 cotton count.

Boil Off and Skein Data 5000 denier skeins were made from this yarn to test for shrinkage, stretch, and recovery. On boil-off the yarns were observed to shrink significantly, and almost all of the shrinkage was retained as recoverable stretch (after boil-off stretch). Using a 0.2 gm per denier weight to extend the skein, the following values were observed after boil-off:

% shrinkage: 7.19%;
Stretch: 41.8%;
Recovery after Stretching: 75.3%

Interpretation

The data indicate that biconstituent cut staple fibers can be blended with typical commercial staple fiber to form composite staple yarns which show greatly enhanced stretch and recovery properties after hot wet finishing. Further the examples below show that knit, woven, and nonwoven fabrics with useful stretch and elastic recovery properties can be made from yarns composed of at least a portion of biconstituent staple fibers.

Example 5A

Woven Fabric

A hand woven sample was created on a frame using the above yarn in both the weft (12 ends per inch) and the warp direction (13 ends per inch). 10 cm×10-cm marks were made the on fabric in the pre-boil-off state. The fabric was then boiled off and the % shrinkage and % stretch measured with the following result:

| | (cm) Marked | ABO | Stretched | After 30 sec. | Shrinkage | Stretch |
|---|---|---|---|---|---|---|
| WARP | 10 | 5 | 8.5 | 5.5 | 50.0% | 70.0% |
| FILL | 10 | 6 | 9.5 | 7 | 40.0% | 58.3% |

Example 5B

Knit Fabric

A Lawson knit tube of the high twist yarn, (ATS004) was knit single end from the blend yarn before boil-off using a dial setting of 5 and a 36–64 cylinder. The knit tube was boiled off by placing in room temperature water and raising the temperature to 100° C., holding at a strong boil for 10 minutes; then the sample was flushed with cool tap water and dewatered using an extractor; finally the fabric was tray dried for 30 minutes at 165 F. The fabric was marked in the greige, and the following absolute shrinkage and recoverable stretch values were measured in the final fabric:
J-120/Cotton Lawson Tubing

| | Marked (inches) | ABO | Stretched | After 30 seconds | Shrinkage | Recovery |
|---|---|---|---|---|---|---|
| MD10 | 7.5 | 11.5 | 8 | 25% | 53.3% | 94% |
| XD3 | 2.52 | 4.125 | 3.2 | 16% | 63.7% | 79% |

Example 6

"Seamlss" Circular Knit Fabrics

Two biconstituent yarns (5*a* and 5*b*) were spun as in previous examples, a monofilament yarn and a five filament yarn, with the apparatus of FIG. 4. Each filament of each yarn had 5 symmetric wing portions from a nylon 6 polymer (CAMACARI) and containing 5% by weight nylon 12 (RISLAN). The core was prepared with a PEBAX™ 3533SN core polymer. The core was 55% by volume of the total filament cross section. The wing portions were interpenetrated ("keylocked") to the core portion. The biconstituent monofilament was 25 denier, as spun, was spun at 500 meters per minute feed roll speed using a 4% by weight primary fiber finish and 7% package finish on the monofilament. The monofilament was relaxed by 20% prior to wind-up with the aid of a steam treatment using 3 pound per square inch steam pressure. The total draw ratio was 4×.

The five filament yarn had a total denier of 34, and was similarly produced in all respects except that the speed roll feed was 420 meters per minute, and no primary finish was used.

The % stretch after boil off, % shrinkage after boil-off, and % recovery from stretch after boil-off are indicated in the table below:

| | Yarn a | Yarn b |
|---|---|---|
| Denier as spun | 34 | 25 |
| # filaments | 5 | 1 |
| Wing/core interpentration | yes | yes |
| Feed Roll Speed (m/min) | 500 | 420 |
| Primary Finish | NY-102 | none |
| Primary Finish % | 4% | 0 |
| Secondary Finish type | K-9349 | K-9349 |
| Secondary Finish % | 7% | 7% |
| Wing Polymer | Camacari N6 | Camacari N6 |
| Wing Polymer Additive | 5% Rilsan | 5% Rilsan |
| Wing Volume % | 45 | 45 |
| No. Wings | 5 | 5 |
| Core Polymer | Pebax 3533SN | Pebax 3533SN |
| Core Volume % | 55 | 55 |
| Draw Ratio | 4 | 4 |
| % Face Plate Relaxation | 20 | 20 |
| Relaxation jet steam pressure system | 3 psi | 3 psi |
| % Stretch after BO | 92 | 98 |
| % Shrinkage after BO | 21 | 19 |
| % Recovery after BO | 90 | 98 |

The 25 denier monofilament yarn 5*a*. and 34 denier five-filament yarn 5*b* were fabricated into seamless circular knit garment tubes using a SANTONI Corp. (Model SM-8 TOP) machine. Four monofilament and four five-filament yarns feeds were fed in a standard stitch pattern where the monofil yarn was used as a float yarn to create a typical patterning effect for a panty garment. Standard Memminger IRO tensioners were used to control yarn feed tension. The fabric construction was a light weight sheer fabric of approximately 95 grams/square meter. The SM-8 machine was set to knit tube samples with a griege layout width of 15.5 inches, and a layout length of 7.5 inches. The griege seamless tubes were autoclaved boarded at 220 F for 5 minutes on a cylindrical porous metal tube form 8.5 inches in diameter. The garment tubes were observed to shrink to match the cylindrical diameter of the form during autoclave steam treatment. The post autoclave boarded tube dimensions were 13.5 in layout width and 7.5 inches in layout length The final garment tube was observed to be uniform, non-picky, and suitable for seamless garment applications such as women's panties. The following hand stretch properties were measured:

| | Greige | Autoclave Boarded |
|---|---|---|
| Width % Stretch | 70% | 85% |
| Width Stretch % Recovery | 90% | 95% |
| Length % Stretch | 79% | 88% |
| Length Stretch % Recovery | 86% | 95% |
| Garment Power | Minimal | Much Higher |

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. A hetero-composite yarn comprising a combined biconstituent yarn and a companion yarn, wherein the biconstituent yarn comprises at least one filament with an axial core comprising a thermoplastic elastomeric polymer, and a plurality of wings attached to the core and comprising a thermoplastic, non-elastomeric polymer.

2. The yarn of claim 1, wherein the filament has a substantially radially symmetric cross-section.

3. The yarn of claim 1, wherein the filament comprises from 3 to 8 wings, has an after boll-off stretch of at least about 20%, requires less than about 10% stretch to substantially straighten the fiber, has a substantially circular core cross-section, and wherein the weight ratio of non-elastomeric wing polymer to elastomeric core polymer is in the range of about 10/90 to about 70/30.

4. The yarn of claim 1, wherein the non-elastomeric polymer is selected from the group consisting of polyamides, non-elastomeric polyolefins, and polyesters, and the elastomeric polymer is selected from the group consisting of thermoplastic polyurethanes, thermoplastic polyester elastomers, thermoplastic polyolefins, thermoplastic polyesteramide elastomers and thermoplastic polyetheramide elastomers.

5. The yarn of claim 1 wherein the non-elastomeric polymer is selected from the group consisting of poly (ethylene terephthalate) and copolymers thereof, poly (trimethylene terephthalate), and poly(tetramethylene terephthalate), and the elastomeric polymer is selected from the group consisting of the reaction products of poly (tetramethyleneether) glycol or poly(tetramethylene-co-2-methyltetramethyleneether) glycol with terephthalic acid or dimethyl terephthalate and a diol selected from the group consisting of 1,3-propane diol and 1,4-butane diol.

6. The yarn of claim 1, wherein the biconstituent yarn comprises an additive to improve adhesion of the wings to the core.

7. A garment or a portion thereof comprising the yarn of claim 1.

8. A yarn of claim 1, wherein the core has a substantially circular or regular polyhedron cross section.

9. The yarn of claim 1, wherein the core of the biconstituent yarn contains an outer radius $R_1$, an inner radius $R_2$, and $R_1/R_2$ is greater than about 1.2.

10. The yarn of claim 9, wherein $R_1/R_2$ is in the range of about 1.3 to about 2.0, the weight ratio of non-elastomeric wing polymer to elastomeric core polymer is in the range of about 10/90 to about 70/30, and the after-boil-off stretch is at least about 20%.

11. A yarn of claim 1, wherein said companion yarn is formed from one or more of a polyamide, polyolefin, polyester, viscose polymer, acetate, bicomponent filament, cotton, wool, silk, and combinations thereof.

12. A yarn of claim 1, wherein said companion yarn is selected from the group consisting of nylon-66, polyesters, polyolefins and natural fibers.

13. The yarn of claim 1, wherein the biconstituent yarn and the companion yarn are combined by interlacing, air mingling, air mingling following false twist texturing of another companion yarn, co-air texturing or staple blending.

* * * * *